US006613715B2

(12) United States Patent
Kutami et al.

(10) Patent No.: US 6,613,715 B2
(45) Date of Patent: Sep. 2, 2003

(54) METHOD OF USING REVERSIBLE THERMOSENSITIVE RECORDING MEDIUM AND THE REVERSIBLE THERMOSENSITIVE RECORDING MEDIUM

(75) Inventors: Atsushi Kutami, Shizuoka (JP); Tetsuya Amano, Shizuoka (JP); Kazumi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/737,130

(22) Filed: Dec. 14, 2000

(65) Prior Publication Data

US 2001/0029236 A1 Oct. 11, 2001

(30) Foreign Application Priority Data

Dec. 17, 1999 (JP) ..... 11-359564

(51) Int. Cl.[7] ..... B41M 5/30
(52) U.S. Cl. ..... 503/201; 503/204; 503/206
(58) Field of Search ..... 503/201, 204, 503/206; 428/29, 195, 913

(56) References Cited

U.S. PATENT DOCUMENTS 4,554,565 A * 11/1985 Kito et al. ..... 346/201

* cited by examiner

*Primary Examiner*—Bruce H. Hess
(74) *Attorney, Agent, or Firm*—Cooper & Dunham LLP

(57) ABSTRACT

A reversible thermosensitive recording medium has a support, a reversible thermosensitive recording layer of which color tone is reversibly changeable with the application of heat thereto, and a printing layer bearing a printed image A. When an image B is formed in the reversible thermosensitive recording layer by heating the recording layer, the image B completes a single composite image in combination with the printed image A. The method of using the above-mentioned recording medium includes the step of forming an image B in the reversible thermosensitive recording layer by heating the recording layer to an image formation temperature to complete a single composite image in combination with the printed image A.

39 Claims, 8 Drawing Sheets

METHOD OF USING REVERSIBLE THERMOSENSITIVE RECORDING MEDIUM AND THE REVERSIBLE THERMOSENSITIVE RECORDING MEDIUM

BACKGROUND OF THE INVENTION

1. Field of the Invention

The present invention relates to a method of using a reversible thermosensitive recording medium capable of forming an image therein and erasing the image therefrom by controlling thermal energy applied to the recording medium, and also relates to the above-mentioned reversible thermosensitive recording medium.

2. Discussion of Background

One of the representative examples of the reversible thermosensitive recording media which have been put to practical use is a reversible thermosensitive recording medium as disclosed in Japanese Laid-Open Utility Model Application 1-165286. Basically, the above-mentioned reversible thermosensitive recording medium comprises a reversible thermosensitive recording layer where an organic low-molecular material is dispersed in a matrix resin. A white opaque image is formed in this recording layer by imagewise heating the recording layer. The white opaque image can be erased when the recording layer is again heated at a temperature that is different from the temperature for image formation so as to return the recording layer to the initial transparent state.

The other example is a reversible thermosensitive recording medium provided with a reversible thermosensitive recording layer comprising an electron-donating coloring compound and an electron-accepting compound as the main components, as disclosed in Japanese Laid-Open Patent Applications 5-124360, 6-210954, 5-92661, and 4-303680. In this kind of reversible thermosensitive recording medium, a color-developed state and a decolorized state are relatively formed by controlling the temperature of the recording medium in the heating operation and/or the cooling rate after the heating operation, thereby achieving image recording and erasure. As the electron-donating coloring compound, a leuco dye is usually employed, so that a variety of colors such as black and blue can be selectively produced.

Such reversible thermosensitive recording media are widely used, in particular, in the form of a card. In the conventional card-shaped reversible thermosensitive recording medium, for instance, a reversible thermosensitive recording portion is disposed in the center of the card, and a printed image portion is provided along the edge of the card, as proposed in Japanese Laid-Open Patent Application 8-15079. In the above-mentioned configuration, the reversible thermosensitive recording portion and the printed image portion are separately arranged, and an image formed in the former portion is not associated with an image formed in the latter portion. Namely, the reversibility of the reversible thermosensitive recording medium is not fully used in the conventional recording method.

SUMMARY OF THE INVENTION

Accordingly, a first object of the present invention is to provide a method of using a reversible thermosensitive recording medium, capable of fully exhibiting the function of reversibility of the reversible thermosensitive recording medium.

Further, a second object of the present invention is to provide a reversible thermosensitive recording medium for use with the above-mentioned method.

The above-mentioned first object of the present invention can be achieved by a method of using a reversible thermosensitive recording medium comprising a support, a reversible thermosensitive recording layer of which color tone is reversibly changeable with the application of heat thereto to change the temperature thereof, and a printing layer which bears a printed image A on the support, the above-mentioned method comprising the step of forming an image B in the reversible thermosensitive recording layer by heating the recording layer to an image formation temperature to complete a single composite image in combination with the printed image A.

The second object of the present invention can be achieved by a reversible thermosensitive recording medium comprising a support, a reversible thermosensitive recording layer of which color tone is reversibly changeable with the application of heat thereto to change the temperature thereof, and a printing layer which bears a printed image A on the support, wherein when an image B is reversibly formed in the reversible thermosensitive recording layer by heating the recording layer, the image B completes a single Composite image in combination with the printed image A.

Alternatively, the second object of the present invention can also be achieved by a reversible thermosensitive recording medium comprising a support, a reversible thermosensitive recording layer of which color tone is reversibly changeable with the application of heat thereto to change the temperature thereof, the reversible thermosensitive recording layer bearing an image B therein, and a printing layer which bears a printed image A, wherein the image B and the printed image A in combination constitute a composite image.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the reversible thermosensitive recording medium of the present invention, a reversible thermosensitive recording layer and a printing layer are provided on a support. The aforementioned printing layer means an image A prepared by printing. The configuration of the reversible thermosensitive recording layer and the printing layer may be freely determined as long as the method of the present invention can be attained. To be more specific, both layers may be separately arranged side by side, or in an overlapping manner. In the latter case, the overlapping order of the two layers is not particularly limited.

The point is that an image A fixedly printed in the printing layer and an image B that is a variable image formed in the reversible thermosensitive recording layer are intentionally associated with each other to constitute a composite image. When viewed from the image display surface of the recording medium, the composite image can be recognized as the previously intended image.

Therefore, a material for an intermediate layer or protection layer, which may be provided between the printing layer and the reversible thermosensitive recording layer or on the surface of the recording medium, is selected so that the obtained composite image can be visually recognized.

Figure 3:
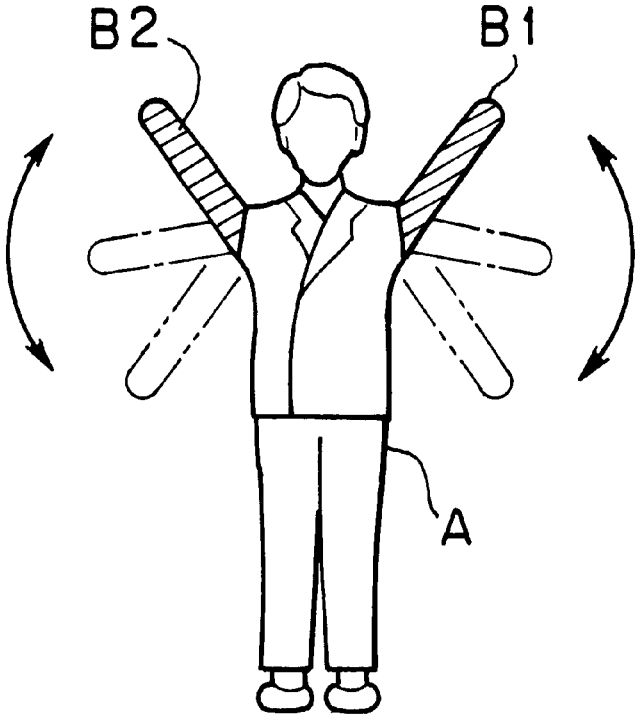
FIG. 3 is a diagram showing one example of a composite image displayed on a reversible thermosensitive recording medium of the present invention.

One embodiment of a composite image is shown in FIG. 3. In this embodiment, the reversible thermosensitive recording layer and the printing layer are arranged so that arm portions can be continuously connected to the body portion without any seam. When images B1 and B2 corresponding to the arm portions are formed in the reversible thermosensitive recording layer, the composite image of FIG. 3 can be completed.

When the reversible thermosensitive recording layer and the printing layer are arranged in an overlapping manner, it is advantageous that three colors can be produced, that is, a single color of the printing layer, a superimposed color of the printing layer and the reversible thermosensitive recording layer in a color-developed state, and a color of the reversible thermosensitive recording layer in a color-developed state.

When a reversible thermosensitive recording layer or the printing layer is provided on substantially the whole surface area of the support, the method of the present invention is preferably applicable to a wide area.

For example, the above-mentioned both kinds of reversible thermosensitive recording media, that is, the white opaque type recording medium, and the recording medium employing a leuco dye are usable in the present invention. In light of the applicability to the color of a printed image, and wide selection of the colors, the leuco-dye containing reversible thermosensitive recording medium is preferably employed in the present invention.

Figure 4:
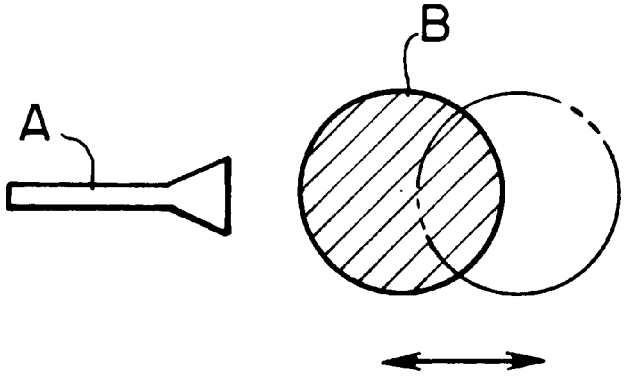
FIG. 4 is a diagram showing another example of a composite image displayed on a reversible thermosensitive recording medium of the present invention.

According to the method of the present invention, an image B is formed in the reversible thermosensitive recording layer so as to show a composite image intentionally designed in combination with a printed image A. A variable action and a variable amount can be thus visually exhibited as illustrated in FIGS. 3, 4 and the like. Namely, a variable action or amount can be visually expressed and recognized by the formation of an image B in the reversible thermosensitive recording layer, with an image A being fixedly printed.

To form a composite image in the reversible thermosensitive recording medium, the image A and the image B are not always connected to each other, but may be separately disposed in the image display surface.

The structure of the reversible thermosensitive recording medium according to the present invention will now be illustratively explained with reference to the figures.

Figure 2:
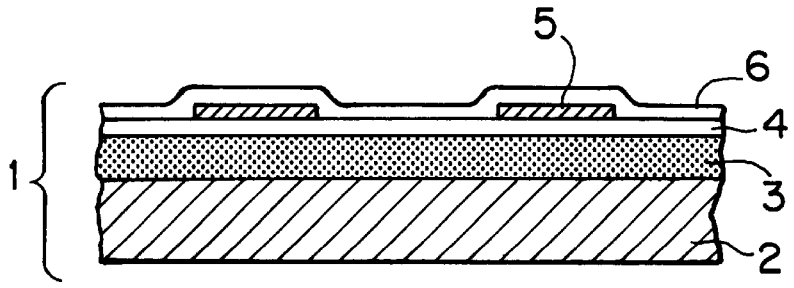
FIG. 2 is a schematic cross-sectional view showing one embodiment of a reversible thermosensitive recording medium according to the present invention.

FIG. 2 is a schematic cross-sectional view showing one preferable example of the structure of a reversible thermosensitive recording medium according to the present invention. In a reversible thermosensitive recording medium 1 of FIG. 2, a reversible thermosensitive recording layer 3, a recording-layer-protection layer 4, a printing layer 5 and a printing-layer-protection layer 6 are successively overlaid on a support 2. The recording-layer-protection layer 4 and the printed-layer-protection layer 6 may be provided when necessary. Other additional layers may be provided when necessary, as described later.

The reversible thermosensitive recording layer 3 may be partially or entirely provided on the support 2. When the reversible thermosensitive recording layer is partially provided, the surface portions of the recording medium other than the reversible thermosensitive recording layer embedded portions may be conveniently subjected to embossing.

Likewise, the printing layer 5 may be partially, as illustrated in FIG. 2, or entirely provided.

The overlapping order of the layers constituting the reversible thermosensitive recording medium of the present invention is not particularly limited to the above-mentioned order of FIG. 2. For example, a printing layer, a printing-layer-protection layer, a reversible thermosensitive recording layer, and a recording-layer-protection layer may be successively provided on a support in this order.

The reversible thermosensitive recording medium may be finally prepared into the form of a card, sheet, or label regardless of the size thereof. The recording medium may be prepared by successively overlaying the reversible thermosensitive recording layer and the printing layer on the support by coating. Further, after the reversible thermosensitive recording layer and the printing layer are provided on the support such as a sheet of paper or plastic film, a support member, which serves as a second support, may be attached to the back side of the support with an adhesive layer. Furthermore, the reversible thermosensitive recording medium according to the present invention may bear a magnetic recording medium, an optical recording medium, or a magneto-optical recording medium. IC memory may be supported on the reversible thermosensitive recording medium. Thus, the recording medium of the present invention can be provided with composite functions.

Not only images, but also characters may be formed on the printing layer. The method for printing such images and characters may be freely selected.

The color of an image formed in the reversible thermosensitive recording layer may be the same or different from the color of the image printed in the printing layer. When the colors are not visually distinguishable, it becomes possible to display a composite image where an image in the reversible thermosensitive recording layer looks movable as being closely connected to a printed-image.

FIG. 3 shows one example of a composite image which is finally formed in the reversible thermosensitive recording medium of the present invention. This image indicates a man who raises his arms. The image of FIG. 3 is made up of an image A, which shows the body of a man except his arms, and images B1 and B2 indicating his arms. The image A is an image printed in the printing layer, while the images B1 and B2 are images formed in the reversible thermosensitive recording layer of the reversible thermosensitive recording medium according to the present invention.

By using different colors for the images A and B, the viewer can identify the two images A and B as being separate portions, and recognize the image B as being movable.

FIG. 4 shows another example of a composite image formed in the reversible thermosensitive recording medium. This image indicates a soap bubble ejected from a straw. In FIG. 4, an image A indicates the straw, which is printed in the printing layer, and an image B indicates the soap bubble, which is formed in the reversible thermosensitive recording layer.

The composite images as illustrated in FIG. 3 and FIG. 4 are embodiments where the image A printed in the printing layer is intentionally associated with the image B formed in the reversible thermosensitive recording layer.

The image A may be printed with a transparent color ink or a conventional opaque color ink. However, when the opaque color ink image A is too thick, it is difficult to see the image B formed in the reversible thermosensitive recording layer because of light shielding by the opaque ink color image B. In such a structure that the printing layer is overlaid on the reversible thermosensitive recording layer, it is preferable that the printing layer constituting the image A have a thickness of 3.0 $\mu$m or less.

From the viewpoint of sufficient light transmission properties of the printed image A, it is preferable to form an image A of the printing layer by dot-printing. When the printed image A and the reversible image B produce substantially the same color, the image A and the image B appear to be connected to each other without any seam. In other words, a dot image is more effective than a solid image as the printed image A when the edges of the images A and B are requested to be joined with no seam.

Namely, the image B formed in the reversible thermosensitive recording layer becomes a dot image when a thermal head is used as the heat application means for the image formation of the image B. Since the images A and B are both dot images, the image A printed in the printing layer does not appear distinguishable from the image B formed in the reversible thermosensitive recording layer when the image A is adjacent to the image B, or the image A and the image B are overlapping.

From the viewpoint of character or image recognition, it is preferable that dot-printing of the printing layer be carried out at a dot density of 100 dpi or more, more preferably 200 to 600 dpi. The upper limit of the printing density by the currently available thermal head is 2,400 dpi, but the dot density for the dot-printing of the printing layer may increase more.

Further, with respect to the dot-printing conditions, it is preferable that the image A be printed so that the total dot area may occupy 20 to 99%, more preferably 70 to 99%, of the total area of the image A because the image B can be clearly seen even when the image A is superimposed on the image B.

For obtaining the above-mentioned effects by dot-printing, it is preferable that the dots have diameters in a range of 0.001 to 1.0 mm. Further, the distance between the adjacent dots should be recognized as a gap, but it is preferable that the adjacent dots be disposed with a distance of 1.0 mm or less.

The above-mentioned dot-printing conditions are effective regardless of the position of the printing layer and the reversible thermosensitive recording layer in the recording medium.

Figure 5A:
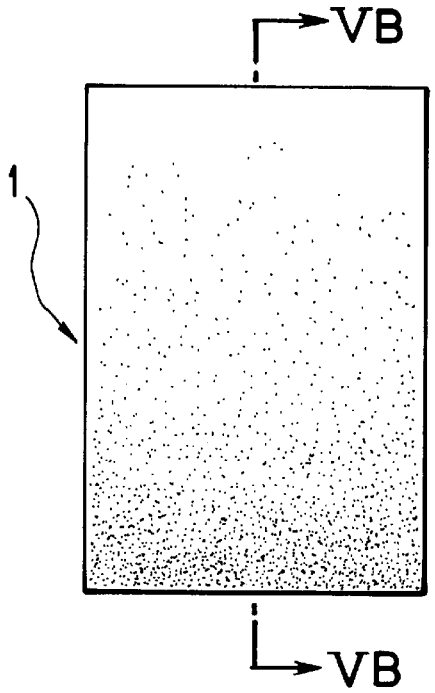
FIG. 5A is a plan view showing one example of a surface of a printing layer of a reversible thermosensitive recording medium according to the present invention.
Figure 5B:
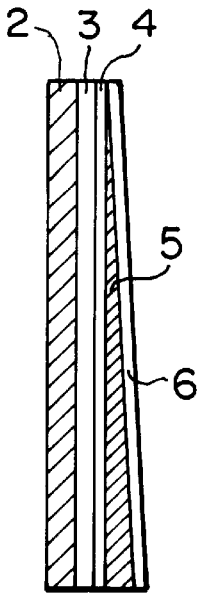
FIG. 5B is a schematic cross-sectional view taken on line VB—VB of FIG. 5A.

FIG. 5A is a plan view showing an example of a surface of a printing layer of a reversible thermosensitive recording medium according to the present invention. FIG. 5B is a schematic cross-sectional view taken on line VB—VB of FIG. 5A. The printing layer 5 in this reversible thermosensitive recording medium is prepared by dot-printing. In FIG. 5A, a printed image is constituted of dots with a gradation so as to have a controlled printing density.

Figure 6A:
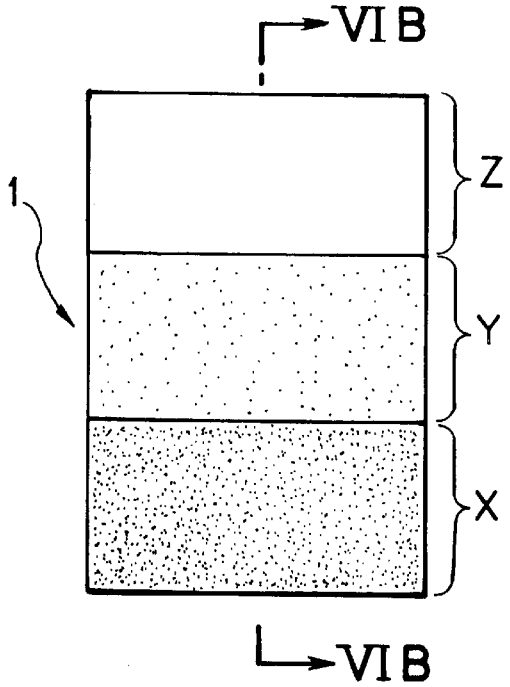
FIG. 6A is a plan view showing another example of a surface of a printing layer of a reversible thermosensitive recording medium according to the present invention.
Figure 6B:
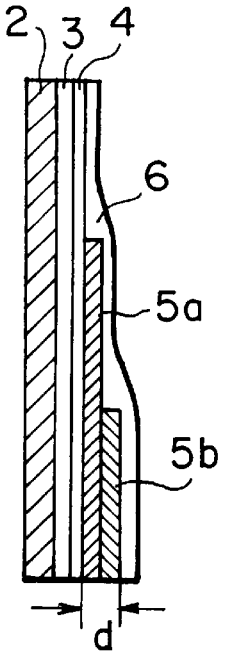
FIG. 6B is a schematic cross-sectional view taken on line VIB—VIB of FIG. 6A.

FIG. 6A is a plan view showing another example of a surface of a printing layer of a reversible thermosensitive recording medium according to the present invention, FIG. 6B is a schematic cross-sectional view taken on line VIB—VIB of FIG. 6A. In this recording medium, printing layers 5*a* and 5*b* are successively overlaid by dot-printing on a reversible thermosensitive recording layer 3 in a partially superimposed manner. A surface area X corresponding to a printed image portion where the printing layer 5*b* is superimposed on the printing layer 5*a* shows a dot image with high density. A surface area Y corresponding to a printed image portion where only the printing layer 5*a* exists shows a dot image with low density. A surface area Z free of any printing layer shows no dot image. When the printing layer 5*a* and the printing layer 5*b* are printed in different colors, the two colors are superimposed in the surface area X. When multiple printing layers are superimposed in the above-mentioned manner, multiple colors can be obtained in the printed image.

However, when the printing layers are superimposed, it is preferable that the maximum thickness of the printing layers be 3 $\mu$m or less. To be more specific, the distance d in FIG. 6B may be controlled to 3 $\mu$m or less. When the distance d exceeds 3 $\mu$m, the surface of the recording medium cannot be smoothly brought into slide contact with a thermal head. Further, since the printing layer is too thick as a whole, the above-mentioned light shielding effect by the printing layer is increased. Furthermore, the printing energy is required to increase in view of heat loss caused by such a thick printing layer, with the result that the surface of the recording medium will deteriorate.

As mentioned above, the printing layer may be a single layer with a single color, or consist of multiple layers with a plurality of colors.

Figure 7A:
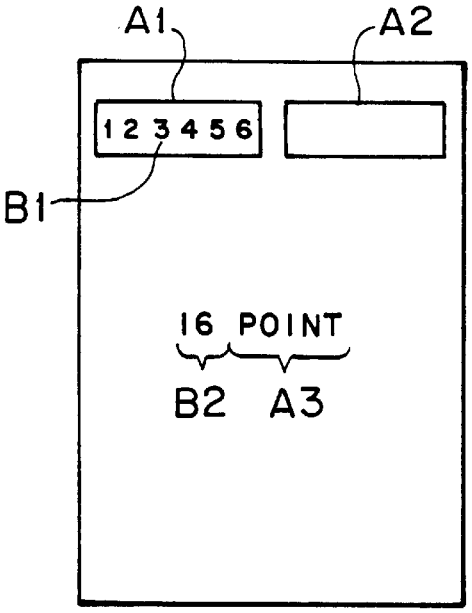
FIG. 7A and FIG. 7B are plan views showing different image display surfaces of the same reversible thermosensitive recording medium of the present invention.
Figure 7B:
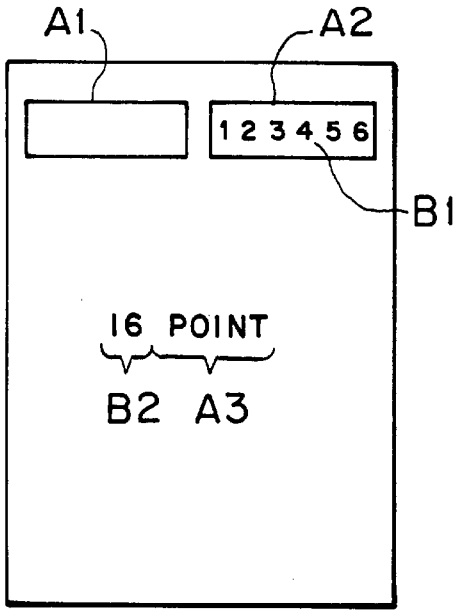

FIG. 7A and FIG. 7B are plan views of the identical reversible thermosensitive recording medium in the form of a card according to the present invention, viewed from the image display surface. This card is a so-called point card available in a game house or the like.

As illustrated in FIG. 7A and FIG. 7B, two square portions A1 and A2 are images solidly printed with a red color and a green color, respectively. Characters arranged in the red portion A1 in FIG. 7A and the green portion A2 in FIG. 7B are legible. Those character images are formed in the reversible thermosensitive recording layer of the card. When the card holder is a woman, her ID number and some other data are written in character forms in the red portion A1 as shown in FIG. 7A, while when the card holder is a man, his ID number and some other data are written in character forms in the green portion A2 as shown in FIG. 7B. Namely, the character images (images B) formed in the reversible thermosensitive recording layer can be seen through the printed image A. Further, in this embodiment, the point data such as "16" is recorded and displayed as an image B2, and characters are previously printed as an image A3. This embodiment shows that an image B in the reversible thermosensitive recording layer and an image A in the printing layer are arranged in an overlapping manner.

Figure 8:
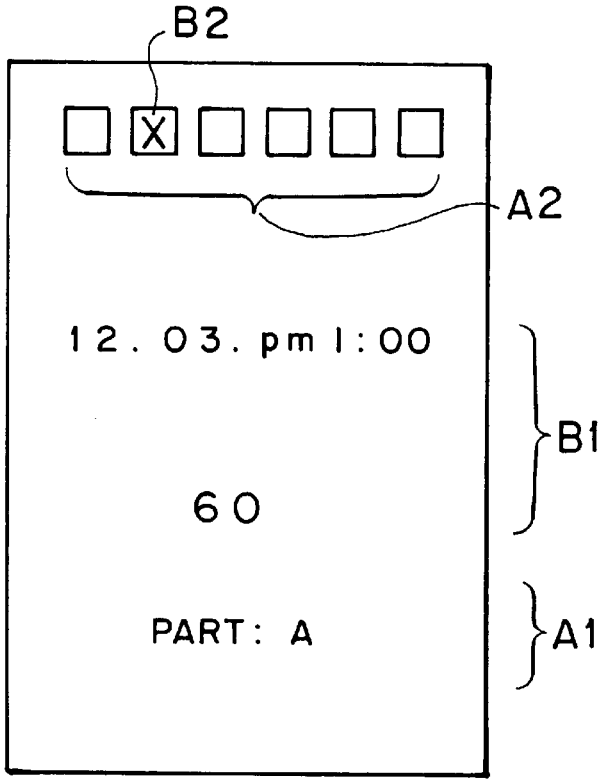
FIG. 8 is a plan view showing another example of a composite image displayed on a reversible thermosensitive recording medium according to the present invention.

FIG. 8 is also a plan view of a reversible thermosensitive recording medium in the form of a card according to the present invention, viewed from the image display surface. This card is, for example, supposed to be held by a person who delivers goods to a factory, and used to manage the delivery of goods. For example, various data about the delivery of a part A, such as the delivery time and the number of parts A delivered that day are recorded as an image B1, which is formed in the reversible thermosensitive recording layer of the recording medium. There are arranged six squares of different colors at the top of the card. The six squares are printed as an image A2, indicating the sections where the parts A may be delivered. A mark "X" in the second square from the left is an image B2 formed in the reversible thermosensitive recording layer. This means the parts A are delivered to the section corresponding to the second square from the left that day. This embodiment shows that the printed image and the image formed in the reversible thermosensitive recording layer are combined in an overlapping manner.

Figure 9:
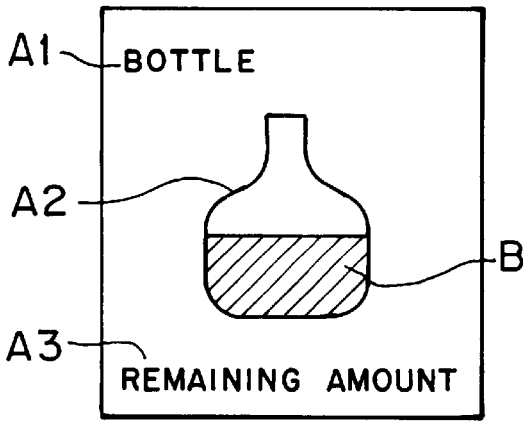
FIG. 9 is a plan view showing another example of a composite image displayed on a reversible thermosensitive recording medium according to the present invention.

FIG. 9 is also a plan view showing a composite image displayed on the surface of a reversible thermosensitive recording medium in the form of a card. In FIG. 9, images A1, A2 and A3 are images printed in the printing layer, and an image B, which is represented by shading, is an image formed in the reversible thermosensitive recording layer. In this case, the image B represents the remaining amount of liquor in the bottle of which the outline is printed as the printed image A2. This embodiment shows the combination of the printed image A and the image B formed in the reversible thermosensitive recording layer complete a composite image that makes sense.

Figure 10:
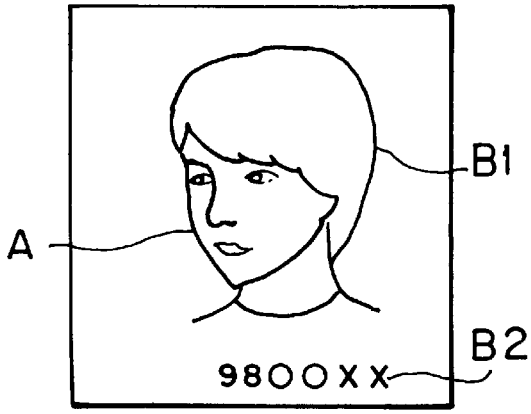
FIG. 10 is a plan view showing another example of a composite image displayed on a reversible thermosensitive recording medium according to the present invention.

FIG. 10 is also a plan view showing a composite image formed on the image display surface of a reversible thermosensitive recording medium in the form of a card. The card holder of this card shown in FIG. 10 is a customer of a hairdresser or barber. An image A is previously printed in the card, which indicates the outline of the features. A hair-style of the card holder which has been formed that day is recorded as an image B1. For example, when the card holder visits the same hairdresser or barber next time, the hairdresser or barber can arrange the hair-style of the card holder with reference to the card which carries the image of the previous hair-style. In FIG. 10, the date is recorded as an image B2 of the reversible thermosensitive recording layer. This embodiment also shows that a combined image constituted of the image B and the printed image A is completed.

Figure 11A:
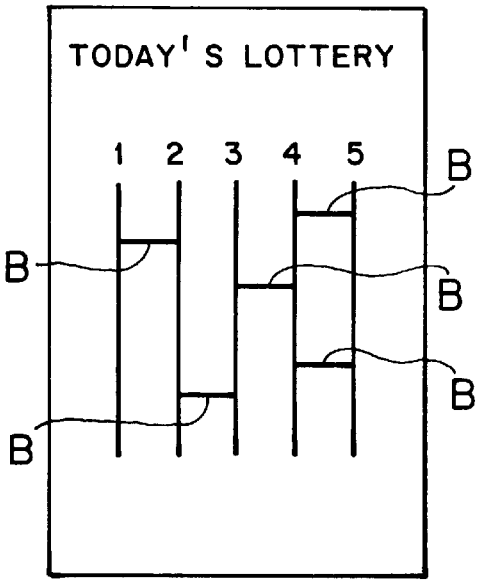
FIG. 11A and FIG. 11B are plan views showing different image display surfaces of the same reversible thermosensitive recording medium according to the present invention.
Figure 11B:
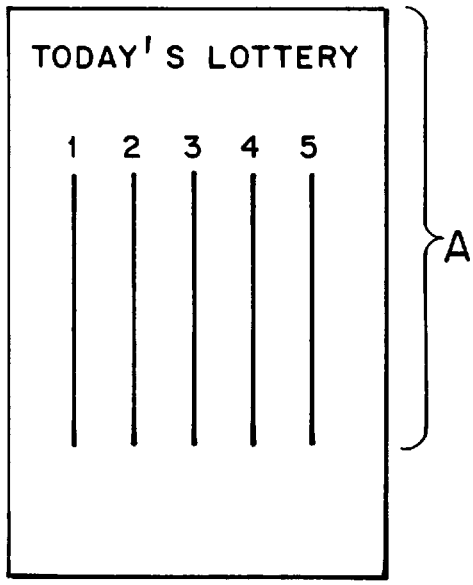

FIG. 11A and FIG. 11B are plan views of the identical reversible thermosensitive recording medium in the form of a card according to the present invention, viewed from the image display surface. This card is a kind of lottery.

Only the printed images A, that is, characters and vertical lines 1 to 5, are originally printed as illustrated in FIG. 11B. Thereafter, between the vertical lines 1 to 5, horizontal lines B are drawn at random in the reversible thermosensitive recording layer, thereby completing the lottery. By erasing the previous horizontal lines from the reversible thermosensitive recording layer and newly recording horizontal lines in a different way, this card can be repeatedly used for lottery. In this embodiment, the printed image A and the reversible image B complete a composite image that makes sense.

Figure 12A:
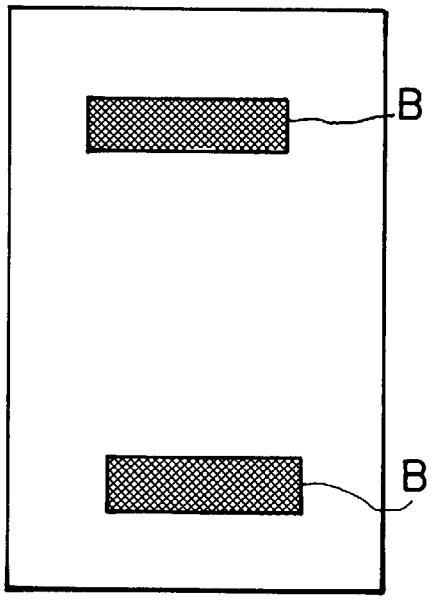
FIG. 12A and FIG. 12B are plan views showing different image display surfaces of the same reversible thermosensitive recording medium according to the present invention, where a printed image can be reversibly made illegible and legible.
Figure 12B:
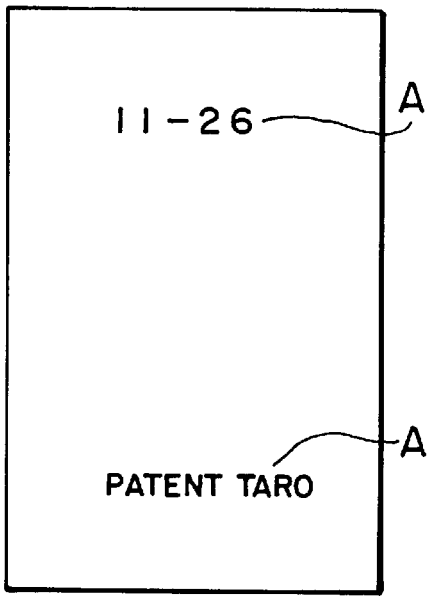

FIG. 12A and FIG. 12B are plan views of the identical reversible thermosensitive recording medium in the form of a card according to the present invention, in explanation of a composite image formed on the image display surface. As shown in FIG. 12B, characters are printed as an image A in the printing layer of the recording medium. When an image B is formed in the reversible thermosensitive recording layer so as to constitute the background of the printed character image A, the printed character image A can be concealed if the colors of the printed character image A and the image B serving as the background are not visually distinguishable. In this embodiment, the printed image A and the image B formed in the reversible thermosensitive recording layer are arranged in an overlapping manner.

Figure 13:
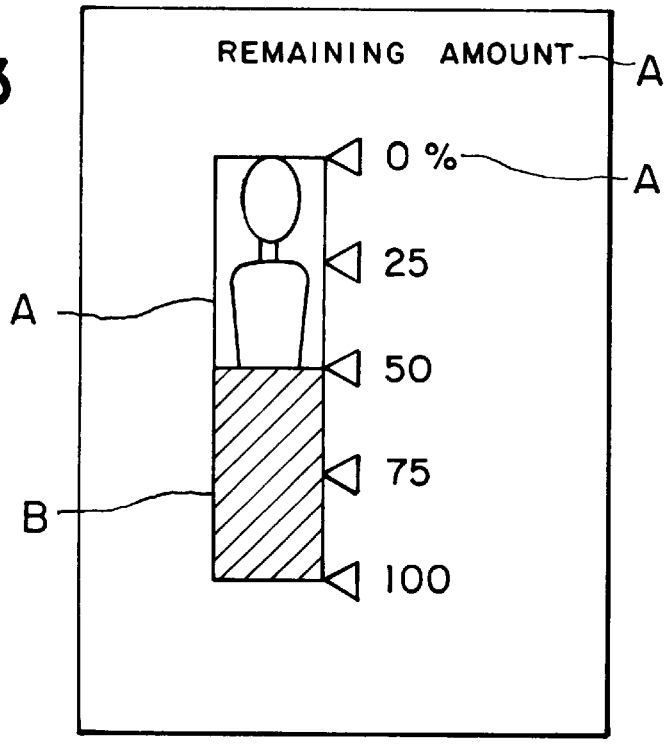
FIG. 13 is a plan view of still another example showing an image display surface of a reversible thermosensitive recording medium according to the present invention.

FIG. 13 is also a plan view showing an example of a composite image displayed on the surface of a reversible thermosensitive recording medium according to the present invention. In the recording medium of FIG. 13, a reversible thermosensitive recording layer is provided on a printing layer.

In this embodiment, characters and the outline of the figure, which are represented by A in FIG. 13, are previously printed in the printing layer. An image B represented by a shaded portion indicates an amount, which is variable. By forming an image B in the reversible thermosensitive recording layer, the printed image A is painted out because the reversible thermosensitive recording layer is overlaid on the printing layer.

In the above-mentioned embodiment, there is another image display method. Namely, the printed figure image is completely painted out by forming an image B represented by the shaded portion in advance. It is possible to allow the printed figure image to gradually appear by erasing the image B little by little.

The method for completing a composite image by combining a fixed image (printed image A) and a variable image (image B formed in the reversible thermosensitive recording layer) according to the present invention is applicable to the formation of a bar code. To be more specific, one bar code image is constituted of two parts, that is, a fixed part and a variable part. The fixed part of the bar code image is printed as an image A in a printing layer of the reversible thermosensitive recording medium of the present invention. The remaining part is formed by an image B in a reversible thermosensitive recording layer. Thus, the formation of the image B can complete an image that makes sense in combination with the printed image A. In other words, a readable information-bearing combined image constituted of the image A and the image B can be completed. Even though the image B is erased, the specific data can be guessed through the remaining image A. Further, false alteration of the bar code can be prevented without any provision of additional functions.

The image A can be fixed in the printing layer by offset printing, flexography, ink-jet printing, or sublimation transfer printing.

The kind of bar code is not particularly limited, and the above-mentioned method can be applied to the formation of two-dimensional bar code and secret bar code.

The structure of the reversible thermosensitive recording medium will now be explained in detail with reference to FIG. 14 to FIG. 17.

Figure 14:
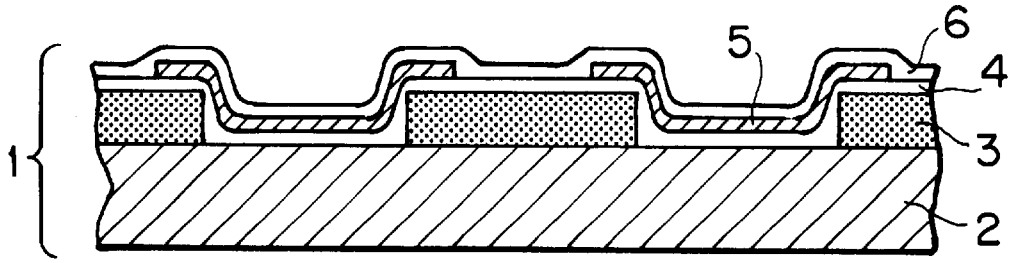
FIG. 14 is a schematic cross-sectional view showing another embodiment of a reversible thermosensitive recording medium according to the present invention.

In a reversible thermosensitive recording medium 1 of FIG. 14, a reversible thermosensitive recording layer 3 is partially provided on a support 2. A printing layer 5 is also partially provided on the reversible thermosensitive recording layer 3 via a recording-layer protection layer 4 in such a configuration that the printing layer 5 and the reversible thermosensitive recording layer 3 partly overlap to form an overlapping portion. Reference numeral 6 indicates a printing-layer protection layer.

Figure 15A:
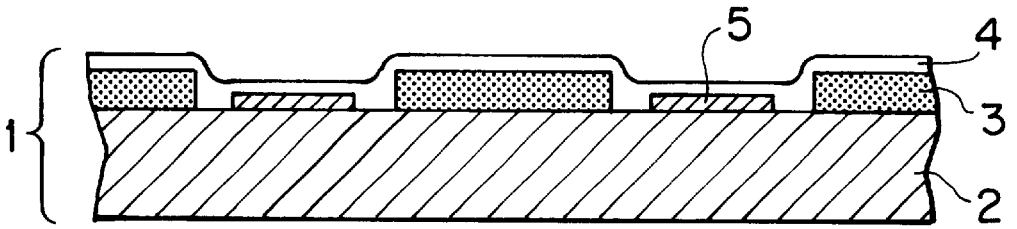
FIG. 15 is a schematic cross-sectional view showing another embodiment of a reversible thermosensitive recording medium according to the present invention.
Figure 15B:
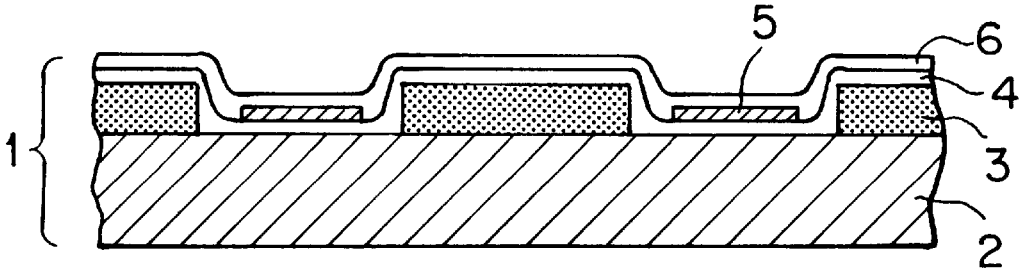

In FIG. 15A and FIG. 15B, a reversible thermosensitive recording layer and a printing layer are independently partitioned. In other words, reversible thermosensitive recording layer portions 3 and printing layer portions 5 are intentionally arranged side by side so as to complete a composite image that makes sense. In FIG. 15A, the reversible thermosensitive recording layer portions 3 and printing layer portions 5 are disposed on the identical surface of the support 2; while, in FIG. 15B, a recording-layer protection layer 4 is interposed between the reversible thermosensitive recording layer portions 3 and the printing layer portions 5.

In the case where the recording medium as shown in FIG. 15A or 15B is used for image display, it becomes possible to complete a composite image in combination of an image A printed in the printing layer portions 5 with an image B formed in the reversible thermosensitive recording layer portions 3, thereby producing a composite image that makes sense. However, the image A cannot be closely connected to the image B, so that the composite image as illustrated in FIG. 3 cannot be obtained.

Figure 16:
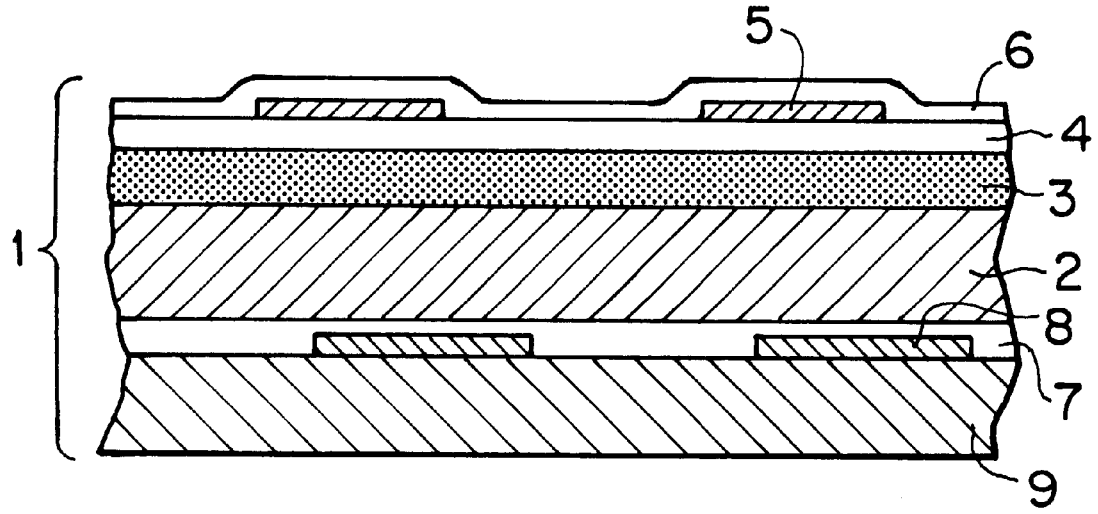
FIG. 16 is a schematic cross-sectional view showing another embodiment of a reversible thermosensitive recording medium according to the present invention.

A reversible thermosensitive recording medium 1 of FIG. 16, a second support 9 is provided on the back side of a support 2 via an adhesive layer 7, opposite to the a reversible thermosensitive recording layer 3 with respect to the support 2. There may be disposed a second printing layer 8 on the adhesive layer side of the second support 9. In this case, the support 2 is required to be transparent. The support 2 and the second support 9 may be made of the same material. Further, the reversible thermosensitive recording medium 1 may further bear thereon an IC memory, a magneto-optical recording medium, an optical recording medium, or a magnetic recording medium.

Figure 17:
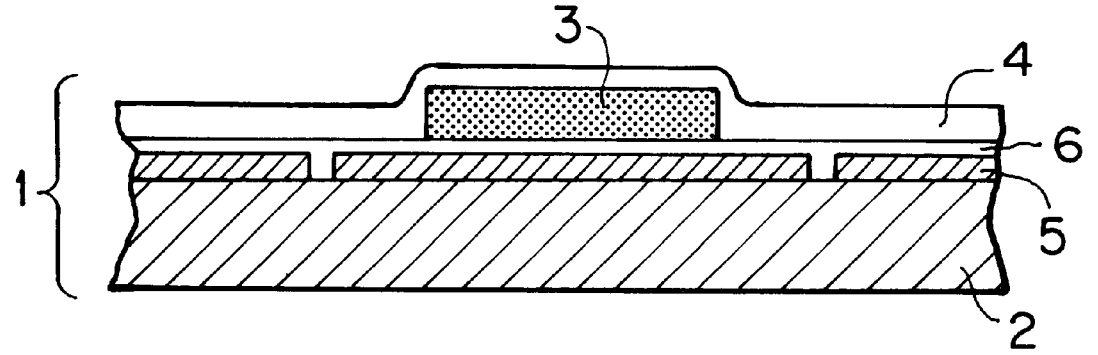
FIG. 17 is a schematic cross-sectional view showing still another embodiment of a reversible thermosensitive recording medium according to the present invention.

In a reversible thermosensitive recording medium 1 of FIG. 17, a printing layer 5, a printing-layer protection layer 6, a reversible thermosensitive recording layer 3, and a recording-layer protection layer 4 are successively overlaid on a support 2. The reversible thermosensitive recording layer 3 is provided in part of a surface of the recording medium 1.

A display apparatus for the reversible thermosensitive recording medium of the present invention comprises recording means and erasing means, and when necessary, cooling means which may be provided subsequent to any of the recording or erasing means. A thermal head is most preferable as the recording means. An image erasing bar is most suitable as the erasing means, but a thermal head is usable as the erasing means.

The materials for use in the reversible thermosensitive recording medium of the present invention will now be described in detail.

For the support 2 and the second support 9 as shown in FIG. 16, a sheet of paper or synthetic paper, a resin film, a metal foil, or a glass plate, and a composite member made of the above-mentioned materials can be used. Any material that can support the recording layer is usable.

In the present invention, a leuco-dye-containing reversible thermosensitive recording medium is preferably used. A reversible thermosensitive coloring composition for use in the reversible thermosensitive recording layer comprises as the main components an electron-donating coloring compound (hereinafter referred to as a coloring agent) and an electron-accepting compound (hereinafter referred to as a color developer). The coloring agent and the color developer are not particularly limited as long as color development and decolorization functions can be reversibly exhibited.

As the color developer for use in the reversible thermosensitive coloring composition, there can be employed any compounds that have not only a molecular structure having a capability of inducing color formation in the coloring agent, but also a long-chain moiety in the molecule which controls the cohesion between the molecules thereof. The color development state can be stabilized when the color developer and the coloring agent form the cohesive structure in combination. When at least one of the color developer or coloring agent causes cohesion or crystallization, the phase separation occurs in the composition of the color developer and the coloring agent, thereby inducing decolorization.

For example, an organic phosphoric acid compound, an aliphatic carboxylic acid compound, and a phenol compound, each having a long-chain hydrocarbon group, can be used as the color developers as disclosed in Japanese Laid-Open Patent Application 5-124360.

As in the color developer for use in the conventional thermosensitive recording medium, acid groups such as phenolic hydroxyl group, carboxyl group, or phosphoric acid group work as a structure capable of inducing color formation in the coloring agent. Any group that can induce color formation in the coloring agent may be used. In addition to the above-mentioned groups, thiourea group and carboxylic acid metallic salt group may be employed.

A hydrocarbon group such as a long-chain alkyl group is one representative example of the structure capable of controlling the cohesion between the molecules. It is preferable that the above-mentioned hydrocarbon group have 8 or more carbon atoms for obtaining satisfactory color development and decolorization properties. The hydrocarbon group may be a straight-chain or branched hydrocarbon group, and may contain an unsaturated bond therein. In the branched hydrocarbon group, the main chain moiety may have 8 or more carbon atoms. The hydrocarbon group may have a substituent such as a halogen atom, hydroxyl group, or an alkoxyl group.

As mentioned above, the color developer is constructed in such a configuration that the structure with color developing capability is connected to the structure, represented by the above-mentioned hydrocarbon group, capable of controlling the cohesion of the molecules. The above-mentioned two structures may be joined together through one or a plurality of hetero-atom-containing bivalent groups as shown in TABLE 1 to TABLE 3. Alternatively, an aromatic ring or heterocyclic ring such as phenylene or naphthylene may be interposed between the two structures. The above-mentioned hetero-atom-containing bivalent groups and aromatic or heterocyclic ring are both contained in the connecting portion. The hydrocarbon group may contain the same bivalent groups as mentioned above, that is, an aromatic ring and a hetero-atom-containing bivalent group, in the chain structure thereof.

Examples of the color developer for use in the present invention are shown below.

Specific examples of the organic phosphoric acid based compounds serving as the color developers are as follows: dodecyl phosphonic acid, tetradecyl phophonic acid, hexadecyl phosphonic acid, octadecyl phosphonic acid, eicosyl phosphonic acid, docosyl phosphonic acid, tetracosyl phosphonic acid, ditetradecyl phosphate, dihexadecyl phosphate, dioctadecyl phosphate, dieicosyl phosphate, and dibehenyl phosphate.

Specific examples of the aliphatic carboxylic acid compounds serving as the color developers are as follows: 2-hydroxytetradecanic acid, 2-hydroxyhexadecanic acid, 2-hydroxyoctadecanic acid, 2-hydroxyeicosanic acid, 2-hydroxydocosanic acid, 2-bromohexadecanic acid, 2-bromooctadecanic acid, 2-bromoeicosanic acid, 2-bromodocosanic acid, 3-bromooctadecanic acid, 3-bromodocosanic acid, 2,3-dibromooctadecanic acid, 2-fluorododecanic acid, 2-fluorotetradecanic acid, 2-fluorohexadecanic acid, 2-fluorooctadecanic acid, 2-fluoroeicosanic acid, 2-fluorodocosanic acid, 2-iodohexadecanic acid, 2-iodooctadecanic acid, 3-iodohexadecanic acid, 3-iodooctadecanic acid, and perfluorooctadecanic acid.

Specific examples of the aliphatic dicarboxylic acid compounds and tricarboxylic acid compounds serving as the color developers are as follows: 2-dodecyloxysuccinic acid, 2-tetradecyloxysuccinic acid, 2-hexadecyloxysuccinic acid, 2-octadecyloxysuccinic acid, 2-eicosyloxysuccinic acid, 2-dodecyloxysuccinic acid, 2-dodecylthiosuccinic acid, 2-tetradecylthiosuccinic acid, 2-hexadecylthiosuccinic acid, 2-octadecylthiosuccinic acid, 2-eicosylthiosuccinic acid, 2-dodecylthiosuccinic acid, 2-tetracosylthiosuccinic-acid, 2-hexadecyldithiosuccinic acid, 2-octadecyldithiosuccinic acid, 2-eicosyldithiosuccinic acid, dodecylsuccinic acid, tetradecylsuccinic acid, pentadecylsuccinic acid, hexadecylsuccinic acid, octadecylsuccinic acid, eicosylsuccinic acid, docosylsuccinic acid, 2,3-dihexadecylsuccinic acid, 2,3-dioctadecylsuccinic acid, 2-methyl-3-hexadecylsuccinic acid, 2-methyl-3-octadecylsuccinic acid, 2-octadecyl-3-hexadecylsuccinic acid, hexadecylmalonic acid, octadecylmalonic acid, eicosylmalonic acid, docosylmalonic acid, dihexadecylmalonic acid, dioctadecylmalonic acid, didocosylmalonic acid, methyloctadecylmalonic acid, 2-hexadecylglutaric acid, 2-octadecylglutaric acid, 2-eicosylglutaric acid, docosylglutaric acid, 2-pentadecyladipic acid, 2-octadecyladipic acid, 2-eicosyladipic acid, 2-docosyladipic acid, 2-hexadecanoyloxypropane-1,2,3-tricarboxylic acid, and 2-octadecanoyloxypropane-1,2,3-tricarboxylic acid.

A carboxylic acid compound represented by the following formula (1) is preferably used as the color developer in the present invention.

$$HOC(=O)-(CH_2)_p-A-(CH_2)_q-X-B-(CH_2)_r-Y-(CH_2)_{s-1}CH_3 \quad (1)$$

Specific examples of the carboxylic acid compound of formula (1) are shown in TABLE 1. In TABLE 1, p, q, r, and s independently show an integer, and A, X, B, and Y independently show a specific structure.

TABLE 1

| p | A | q | X | B | r | Y | s |
|---|---|---|---|---|---|---|---|
| 0 | — | 0 | CO | — | 0 | — | 12 |
| 0 | — | 0 | CO | — | 0 | — | 16 |
| 0 | — | 0 | CO | — | 0 | — | 18 |
| 1 | — | 0 | CO | — | 0 | — | 14 |
| 1 | — | 0 | CO | — | 0 | — | 18 |
| 1 | — | 0 | CO | — | 0 | — | 22 |
| 2 | — | 0 | CO | — | 0 | — | 16 |
| 1 | — | 0 | $SO_2$ | — | 0 | — | 14 |
| 2 | — | 0 | $SO_2$ | — | 0 | — | 18 |
| 2 | — | 0 | $SO_2$ | — | 0 | — | 20 |
| 4 | — | 0 | $SO_2$ | — | 0 | — | 18 |
| 5 | — | 0 | $SO_2$ | — | 0 | — | 11 |
| 6 | — | 0 | $SO_2$ | — | 0 | — | 18 |
| 3 | — | 0 | $SO_2$ | — | 4 | S | 12 |
| 2 | — | 0 | $SO_2$ | p-phenylene | 0 | S | 18 |
| 1 | — | 0 | $SO_2$ | — | 3 | $SO_2$ | 16 |
| 4 | — | 0 | $SO_2$ | — | 10 | CONH | 6 |
| 2 | — | 0 | $SO_2$ | p-phenylene | 0 | CONH | 18 |
| 3 | — | 0 | $SO_2$ | — | 3 | $SO_2NH$ | 16 |
| 1 | — | 0 | $SO_2$ | — | 6 | OCO | 10 |
| 4 | — | 0 | $SO_2$ | — | 10 | NHCO | 14 |
| 2 | — | 0 | $SO_2$ | — | 2 | $NHSO_2$ | 18 |
| 2 | — | 0 | $SO_2$ | — | 6 | NHCONH | 14 |
| 2 | — | 0 | $SO_2$ | p-phenylene | 0 | NHCONH | 18 |

TABLE 1-continued

| p | A | q | X | B | r | Y | s |
|---|---|---|---|---|---|---|---|
| 2 | — | 0 | $SO_2$ | — | 3 | NHCOO | 16 |
| 2 | — | 0 | $SO_2$ | p-phenylene | 0 | OCONH | 18 |
| 4 | — | 0 | $SO_2$ | — | 2 | CONHCO | 16 |
| 2 | — | 0 | $SO_2$ | — | 12 | NHCONHCO | 8 |
| 3 | — | 0 | $SO_2$ | — | 6 | CONHNHCO | 16 |
| 4 | — | 0 | $SO_2$ | — | 4 | CONHCONH | 14 |
| 5 | — | 0 | $SO_2$ | — | 10 | NHCONHNH | 10 |
| 2 | — | 0 | $SO_2$ | — | 2 | NHNHCONH | 18 |
| 3 | — | 0 | $SO_2$ | — | 6 | NHCOCONH | 20 |
| 4 | — | 0 | $SO_2$ | — | 6 | NHCONHNHCO | 18 |
| 2 | — | 0 | $SO_2$ | p-phenylene | 8 | CONHNHCOO | 18 |
| 2 | — | 0 | $SO_2$ | — | 4 | CONHNHCONH | 18 |
| 2 | — | 0 | S | — | 0 | — | 20 |
| 1 | — | 0 | S | — | 0 | — | 14 |
| 2 | — | 0 | S | — | 0 | — | 16 |
| 2 | — | 0 | S | — | 0 | — | 18 |
| 3 | — | 0 | S | — | 0 | — | 22 |
| 3 | — | 0 | S | — | 4 | S | 12 |
| 2 | — | 0 | S | p-phenylene | 0 | S | 18 |
| 1 | — | 0 | S | — | 3 | $SO_2$ | 16 |
| 2 | — | 0 | S | — | 2 | CONH | 18 |
| 2 | — | 0 | S | p-phenylene | 0 | CONH | 18 |
| 3 | — | 0 | S | — | 3 | $SO_2NH$ | 16 |
| 2 | — | 0 | S | — | 1 | NHCO | 18 |
| 2 | — | 0 | S | — | 2 | $NHSO_2$ | 18 |
| 3 | — | 0 | S | — | 12 | NHCONH | 8 |
| 2 | — | 0 | S | p-phenylene | 0 | NHCONH | 18 |
| 2 | — | 0 | S | — | 3 | NHCOO | 16 |
| 2 | — | 0 | S | p-phenylene | 0 | OCONH | 18 |
| 4 | — | 0 | S | — | 2 | CONECO | 16 |
| 2 | — | 0 | S | — | 4 | NHCONHNH | 18 |
| 3 | — | 0 | S | — | 6 | CONHNHCO | 16 |
| 4 | — | 0 | S | — | 4 | CONHCONH | 14 |
| 2 | — | 0 | S | — | 2 | NHNHCONE | 18 |
| 3 | — | 0 | S | — | 6 | NHCOCONH | 20 |
| 4 | — | 0 | S | — | 6 | NHCONHNHCO | 18 |
| 2 | — | 0 | S | — | 4 | CONHNHCONH | 18 |
| 2 | — | 0 | HNCO | — | 0 | — | 20 |
| 1 | — | 0 | HNCO | — | 0 | — | 12 |
| 2 | — | 0 | HNCO | — | 0 | — | 18 |
| 3 | — | 0 | HNCO | — | 0 | — | 22 |
| 4 | — | 0 | HNCO | — | 0 | — | 18 |
| 3 | — | 0 | HNCO | — | 4 | S | 12 |
| 2 | — | 0 | HNCO | p-phenylene | 0 | S | 18 |
| 1 | — | 0 | HNCO | — | 3 | $SO_2$ | 16 |
| 2 | — | 0 | HNCO | — | 2 | CONH | 18 |
| 3 | — | 0 | HNCO | — | 3 | $SO_2NH$ | 16 |
| 4 | — | 0 | HNCO | — | 3 | SCO | 16 |
| 4 | — | 0 | HNCO | — | 10 | NHCO | 14 |
| 4 | — | 0 | HNCO | — | 6 | N=CH | 16 |
| 2 | — | 0 | HNCO | — | 6 | NHCONH | 14 |
| 2 | — | 0 | HNCO | p-phenylene | 0 | NHCONH | 18 |
| 4 | — | 0 | HNCO | — | 4 | OCONH | 18 |
| 2 | — | 0 | HNCO | p-phenylene | 0 | OCONH | 18 |
| 3 | — | 0 | HNCO | — | 6 | NHCSO | 18 |
| 2 | — | 0 | HNCO | — | 12 | NHCONHCO | 8 |
| 3 | — | 0 | HNCO | — | 6 | CONHNHCO | 16 |
| 4 | — | 0 | HNCO | — | 4 | CONHCONH | 14 |
| 5 | — | 0 | HNCO | — | 10 | NHCONHNH | 10 |
| 3 | — | 0 | HNCO | — | 6 | NHCOCONH | 20 |
| 2 | — | 0 | HNCO | p-phenylene | 8 | CONHNHCOO | 18 |
| 1 | — | 0 | CONH | — | 0 | — | 12 |
| 2 | — | 0 | CONH | — | 0 | — | 16 |
| 2 | — | 0 | CONH | — | 0 | — | 18 |
| 3 | — | 0 | CONH | — | 0 | — | 22 |
| 5 | — | 0 | CONH | — | 0 | — | 11 |
| 2 | — | 0 | CONH | p-phenylene | 0 | S | 18 |
| 1 | — | 0 | CONH | — | 3 | $SO_2$ | 16 |
| 2 | — | 0 | CONH | — | 2 | CONH | 18 |
| 2 | — | 0 | CONH | p-phenylene | 0 | CONH | 18 |
| 4 | — | 0 | CONH | — | 3 | SCO | 16 |
| 1 | — | 0 | CONH | — | 6 | OCO | 10 |
| 4 | — | 0 | CONH | — | 10 | NHCO | 14 |
| 2 | — | 0 | CONH | — | 4 | COO | 22 |
| 2 | — | 0 | CONH | — | 2 | $NHSO_2$ | 18 |
| 3 | — | 0 | CONH | — | 12 | NHCONH | 8 |
| 2 | — | 0 | CONH | p-phenylene | 0 | NHCONH | 18 |

TABLE 1-continued

| p | A | q | X | B | r | Y | s |
|---|---|---|---|---|---|---|---|
| 5 | — | 0 | CONH | — | 2 | NHSOO | 20 |
| 2 | — | 0 | CONH | — | 3 | NHCOO | 16 |
| 4 | — | 0 | CONH | — | 4 | OCONH | 18 |
| 2 | — | 0 | CONH | p-phenylene | 0 | OCONH | 18 |
| 3 | — | 0 | CONH | — | 6 | NHCSO | 18 |
| 4 | — | 0 | CONH | — | 2 | CONHCO | 16 |
| 2 | — | 0 | CONH | — | 12 | NHCONHCO | 8 |
| 3 | — | 0 | CONH | — | 6 | CONHNHCO | 16 |
| 4 | — | 0 | CONH | — | 4 | CONHCONH | 14 |
| 2 | — | 0 | CONH | — | 2 | NHNHCONH | 18 |
| 3 | — | 0 | CONH | — | 6 | NHCOCONH | 20 |
| C | — | 0 | CONH | — | 6 | NHCONHNHCO | 18 |
| 2 | — | 0 | CONH | p-phenylene | 8 | CONHNHCOO | 18 |
| 2 | — | 0 | NHCONH | — | 0 | — | 20 |
| 2 | — | 0 | NHCONH | — | 0 | — | 16 |
| 2 | — | 0 | NHCONH | — | 0 | — | 18 |
| 3 | — | 0 | NHCONH | — | 0 | — | 22 |
| 4 | — | 0 | NHCONH | — | 0 | — | 18 |
| 3 | — | 0 | NHCONH | — | 4 | S | 12 |
| 2 | — | 0 | NHCONH | p-phenylene | 0 | S | 18 |
| 1 | — | 0 | NHCONH | — | 3 | $SO_2$ | 16 |
| 4 | — | 0 | NHCONH | — | 10 | CONH | 6 |
| 2 | — | 0 | NHCONH | p-phenylene | 0 | CONH | 18 |
| 3 | — | 0 | NHCONH | — | 3 | $SO_2NH$ | 16 |
| 4 | — | 0 | NHCONH | — | 3 | SCO | 16 |
| 4 | — | 0 | NHCONH | — | 10 | NHCO | 14 |
| 3 | — | 0 | NHCONH | — | 12 | COS | 6 |
| 2 | — | 0 | NHCONH | — | 4 | COO | 22 |
| 2 | — | 0 | NHCONH | — | 6 | NHCONH | 14 |
| 2 | — | 0 | NHCONH | p-phenylene | 0 | NHCONH | 18 |
| 5 | — | 0 | NHCONH | — | 2 | NHSONH | 20 |
| 2 | — | 0 | NHCONH | — | 3 | NHCOO | 16 |
| 2 | — | 0 | NHCONH | p-phenylene | 0 | OCONH | 18 |
| 1 | — | 0 | NHCONH | — | 3 | NHCOO | 14 |
| 3 | — | 0 | NHCONH | — | 6 | NHCSO | 18 |
| 2 | — | 0 | NHCONH | — | 12 | NNCONHCO | 8 |
| 2 | — | 0 | NHCONH | — | 4 | NHCONHNH | 18 |
| 3 | — | 0 | NHCONH | — | 6 | CONHNHCO | 16 |
| 4 | — | 0 | NHCONH | — | 4 | CONHCONH | 14 |
| 5 | — | 0 | NHCONH | — | 10 | NHCONHNH | 10 |
| 2 | — | 0 | NHCONH | — | 2 | NHNHCONH | 18 |
| 3 | — | 0 | NHCONH | — | 6 | NHCOCONH | 20 |
| 2 | — | 0 | NHCONH | — | 4 | CONHNHCONH | 18 |
| 1 | p-phenylene | 0 | NHCONH | — | 0 | — | 18 |
| 1 | p-phenylene | 0 | NHCONH | — | 0 | — | 22 |
| 2 | p-phenylene | 0 | NHCONH | — | 0 | — | 16 |
| 3 | p-phenylene | 0 | NHCONH | — | 0 | — | 18 |
| 1 | p-phenylene | 1 | NHCONH | — | 0 | — | 18 |
| 1 | p-phenylene | 2 | NHCONN | — | 0 | — | 16 |
| 2 | p-phenylene | 1 | NHCONH | — | 0 | — | 20 |
| 1 | p-phenylene | 0 | NHCONH | — | 6 | O | 16 |
| 1 | p-phenylene | 1 | NHCONH | — | 2 | O | 18 |
| 2 | p-phenylene | 0 | NHCONH | — | 8 | O | 14 |
| 2 | p-phenylene | 0 | NHCONH | p-phenylene | 0 | O | 18 |
| 1 | p-phenylene | 0 | NHCONH | p-phenylene | 0 | OCO | 20 |
| 1 | p-phenylene | 2 | NHCONH | p-phenylene | 0 | CO | 18 |
| 1 | p-phenylene | 0 | NHCONH | p-phenylene | 0 | S | 22 |
| 2 | p-phenylene | 0 | NHCONH | p-phenylene | 0 | NHCO | 16 |
| 1 | p-phenylene | 0 | NHCONH | p-phenylene | 0 | CONH | 18 |
| 1 | p-phenylene | 1 | NHCONH | p-phenylene | 0 | NHCONH | 18 |
| 1 | p-phenylene | 0 | NHCONH | p-phenylene | 0 | COO | 20 |
| 2 | p-phenylene | 0 | NHCONH | p-phenylene | 0 | $SO_2$ | 14 |
| 1 | p-phenylene | 0 | NHCO | — | 0 | — | 18 |
| 1 | p-phenylene | 0 | NHCO | — | 0 | — | 22 |
| 2 | p-phenylene | 0 | NHCO | — | 0 | — | 16 |
| 2 | p-phenylene | 0 | NHCO | — | 0 | — | 18 |
| 1 | p-phenylene | 1 | NHCO | — | 0 | — | 18 |
| 1 | p-phenylene | 2 | NHCO | — | 0 | — | 16 |
| 2 | p-phenylene | 1 | NHCO | — | 0 | — | 20 |
| 1 | p-phenylene | 0 | NHCO | — | 6 | O | 16 |
| 1 | p-phenylene | 1 | NHCO | — | 2 | O | 18 |
| 2 | p-phenylene | 0 | NHCO | — | 8 | O | 14 |
| 2 | p-phenylene | 0 | NHCO | p-phenylene | 0 | O | 18 |
| 1 | p-phenylene | 0 | NHCO | p-phenylene | 0 | OCO | 20 |
| 1 | p-phenylene | 2 | NHCO | p-phenylene | 0 | CO | 18 |
| 1 | p-phenylene | 0 | NHCO | p-phenylene | 0 | S | 22 |
| 2 | p-phenylene | 0 | NHCO | p-phenylene | 0 | NHCO | 16 |

TABLE 1-continued

| p | A | q | X | B | r | Y | s |
|---|---|---|---|---|---|---|---|
| 1 | p-phenylene | 0 | NHCO | p-phenylene | 0 | CONH | 18 |
| 1 | p-phenylene | 1 | NHCO | p-phenylene | 0 | NHCONH | 18 |
| 1 | p-phenylene | 0 | NHCO | p-phenylene | 0 | COO | 20 |
| 2 | p-phenylene | 0 | NHCO | p-phenylene | 0 | $SO_2$ | 14 |
| 1 | p-phenylene | 0 | CONH | — | 0 | — | 18 |
| 1 | p-phenylene | 0 | CONH | — | 0 | — | 22 |
| 2 | p-phenylene | 0 | CONH | — | 0 | — | 16 |
| 3 | p-phenylene | 0 | CONH | — | 0 | — | 18 |
| 1 | p-phenylene | 1 | CONH | — | 0 | — | 18 |
| 1 | p-phenylene | 2 | CONH | — | 0 | — | 16 |
| 2 | p-phenylene | 1 | CONH | — | 0 | — | 20 |
| 1 | p-phenylene | 0 | CONH | — | 6 | O | 16 |
| 1 | p-phenylene | 1 | CONH | — | 2 | O | 18 |
| 2 | p-phenylene | 0 | CONH | — | 8 | O | 14 |
| 2 | p-phenylene | 0 | CONH | p-phenylene | 0 | O | 18 |
| 1 | p-phenylene | 0 | CONH | p-phenylene | 0 | OCO | 20 |
| 1 | p-phenylene | 2 | CONH | p-phenylene | 0 | CO | 18 |
| 1 | p-phenylene | 0 | CONH | p-phenylene | 0 | S | 22 |
| 2 | p-phenylene | 0 | CONH | p-phenylene | 0 | NHCO | 16 |
| 2 | p-phenylene | 0 | CONH | p-phenylene | 0 | CONH | 18 |
| 1 | p-phenylene | 1 | CONH | p-phenylene | 0 | NHCONH | 18 |
| 1 | p-phenylene | 0 | CONH | p-phenylene | 0 | COO | 20 |
| 2 | p-phenylene | 0 | CONH | p-phenylene | 0 | $SO_2$ | 14 |
| 1 | p-phenylene | 0 | OCONH | — | 0 | — | 18 |
| 2 | p-phenylene | 0 | OCONH | — | 0 | — | 16 |
| 3 | p-phenylene | 0 | OCONH | — | 0 | — | 18 |
| 1 | p-phenylene | 1 | OCONH | — | 0 | — | 18 |
| 1 | p-phenylene | 2 | OCONH | — | 0 | — | 16 |
| 2 | p-phenylene | 1 | OCONH | — | 0 | — | 20 |
| 1 | p-phenylene | 0 | OCONH | — | 6 | O | 16 |
| 1 | p-phenylene | 1 | OCONH | — | 2 | O | 18 |
| 2 | p-phenylene | 0 | OCONH | — | 8 | O | 14 |
| 2 | p-phenylene | 0 | OCONH | p-phenylene | 0 | O | 18 |
| 1 | p-phenylene | 0 | OCoNH | p-phenylene | 0 | OCO | 20 |
| 1 | p-phenylene | 2 | OCONH | p-phenylene | 0 | CO | 18 |
| 2 | p-phenylene | 0 | OCONH | p-phenylene | 0 | S | 22 |
| 2 | p-phenylene | 0 | OCONH | p-phenylene | 0 | NHCO | 16 |
| 1 | p-phenylene | 0 | OCONH | p-phenylene | 0 | CONH | 18 |
| 1 | p-phenylene | 1 | OCONH | p-phenylene | 0 | NHCONH | 18 |
| 1 | p-phenylene | 0 | OCONH | p-phenylene | 0 | COO | 20 |
| 2 | p-phenylene | 0 | OCONH | p-phenylene | 0 | $SO_2$ | 14 |
| 1 | p-phenylene | 0 | COO | — | 0 | — | 18 |
| 2 | p-phenylene | 0 | OCO | — | 0 | — | 16 |
| 3 | p-phenylene | 0 | COO | — | 0 | — | 18 |
| 1 | p-phenylene | 1 | OCO | — | 0 | — | 10 |
| 1 | p-phenylene | 2 | COO | — | 0 | — | 16 |
| 2 | p-phenylene | 1 | OCO | — | 0 | — | 20 |
| 1 | p-phenylene | 0 | COO | — | 6 | O | 16 |
| 1 | p-phenylene | 1 | OCO | — | 2 | O | 18 |
| 2 | p-phenylene | 0 | COO | — | 8 | O | 14 |
| 2 | p-phenylene | 0 | OCO | p-phenylene | 0 | O | 18 |
| 1 | p-phenylene | 0 | OCO | p-phenylene | 0 | OCO | 20 |
| 1 | p-phenylene | 2 | COO | p-phenylene | 0 | CO | 18 |
| 1 | p-phenylene | 0 | OCO | p-phenylene | 0 | S | 22 |
| 2 | p-phenylene | 0 | COO | p-phenylene | 0 | NHCO | 16 |
| 1 | p-phenylene | 0 | COO | p-phenylene | 0 | CONH | 18 |
| 1 | p-phenylene | 1 | OCO | p-phenylene | 0 | NHCONH | 18 |
| 1 | p-phenylene | 0 | COO | p-phenylene | 0 | COO | 20 |
| 2 | p-phenylene | 0 | OCO | p-phenylene | 0 | $SO_2$ | 14 |
| 1 | p-phenylene | 0 | O | — | 0 | — | 14 |
| 1 | p-phenylene | 0 | S | — | 0 | — | 18 |
| 1 | p-phenylene | 0 | $SO_2$ | — | 0 | — | 22 |
| 2 | p-phenylene | 0 | O | — | 0 | — | 16 |
| 3 | p-phenylene | 0 | S | — | 0 | — | 18 |
| 2 | p-phenylene | 1 | $SO_2$ | — | 0 | — | 18 |
| 1 | p-phenylene | 2 | O | — | a | — | 16 |
| 2 | p-phenylene | 1 | S | — | 0 | — | 20 |
| 1 | p-phenylene | 0 | $SO_2$ | — | 6 | O | 16 |
| 1 | p-phenylene | 1 | O | — | 2 | O | 18 |
| 2 | p-phenylene | 0 | S | — | 8 | O | 14 |
| 2 | p-phenylene | 0 | $SO_2$ | p-phenylene | 0 | O | 18 |
| 1 | p-phenylene | 0 | O | p-phenylene | 0 | OCO | 20 |
| 1 | p-phenylene | 2 | S | p-phenylene | 0 | CO | 18 |
| 1 | p-phenylene | 0 | $SO_2$ | p-phenylene | 0 | S | 22 |
| 2 | p-phenylene | 0 | O | p-phenylene | 0 | NHCO | 16 |
| 1 | p-phenylene | 0 | S | p-phenylene | 0 | CONH | 18 |
| 1 | p-phenylene | 1 | O | p-phenylene | 0 | NHCONH | 18 |

TABLE 1-continued

| p | A | q | X | B | r | Y | s |
|---|---|---|---|---|---|---|---|
| 2 | p-phenylene | 0 | $SO_2$ | p-phenylene | 0 | COO | 20 |
| 2 | p-phenylene | 0 | $SO_2$ | p-phenylene | 0 | $SO_2$ | 14 |

A carboxylic acid compound represented by the following formula (2) is also preferably used as the color developer in the present invention.

(2)

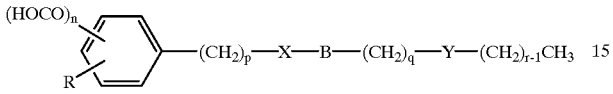

Specific examples of the carboxylic acid compound of formula (2) are shown in TABLE 2. In TABLE 2, n, p, q, and r independently show an integer, and R, X, and Y independently show a specific structure.

TABLE 2

| n | R | p | X | B | q | Y | r |
|---|---|---|---|---|---|---|---|
| 1(4-) | — | 0 | NHCONH | — | 0 | — | 18 |
| 1(4-) | — | 1 | NHCONH | — | 0 | — | 20 |
| 2(3-, 5-) | — | 0 | NHCONH | — | 0 | — | 14 |
| 2(4-) | (3-OH) | 0 | NHCONH | — | 0 | — | 18 |
| 1(4-) | (2-CH3) | 0 | NHCONH | — | 0 | — | 16 |
| 1(4-) | (3-Cl) | 2 | NHCONH | — | 0 | — | 18 |
| 1(3-) | (4-OH) | 0 | NHCONH | — | 0 | — | 22 |
| 1(4-) | (3-OH) | 0 | NHCONH | — | 6 | O | 14 |
| 1(4-) | (3-OH) | 1 | NHCONH | p-phenylene | 0 | O | 18 |
| 1(4-) | (3-Cl) | 0 | NHCONH | p-phenylene | 0 | S | 16 |
| 1(3-) | (4-OH) | 0 | NHCONH | p-phenylene | 0 | NHCO | 18 |
| 1(3-) | (4-OH) | 0 | NHCONH | p-phenylene | 0 | CONH | 20 |
| 1(4-) | (3-OH) | 0 | NHCONH | p-phenylene | 0 | NHCONH | 18 |
| 1(4-) | (3-$OCH_3$) | 1 | NHCONH | p-phenylene | 0 | OCO | 14 |
| 1(4-) | (3-OH) | 0 | NHCONH | p-phenylene | 0 | COO | 18 |
| 1(4-) | (3-Cl) | 0 | NHCONH | p-phenylene | 0 | $SO_2$ | 18 |
| 1(4-) | (3-OH) | 0 | NHCONH | p-phenylene | 0 | $SO_2NH$ | 18 |
| 1(4-) | — | 0 | NHCO | — | 0 | — | 18 |
| 1(4-) | — | 2 | NHCO | — | 0 | — | 20 |
| 2(3-,4-) | — | 0 | NHCO | — | 0 | — | 14 |
| 2(4-) | (3-OH) | 0 | NHCO | — | 0 | — | 18 |
| 1(4-) | (2-$CH_3$) | 0 | NHCO | — | 0 | — | 16 |
| 1(4-) | (3-Cl) | 2 | NHCO | — | 0 | — | 18 |
| 1(3-) | (4-OH) | 0 | NHCO | — | 0 | — | 22 |
| 114-) | (3-OH) | 0 | NHCO | — | 6 | O | 14 |
| 1(4-) | (3-OH) | 1 | NHCO | p-phenylene | 0 | O | 18 |
| 1(4-) | (3-Cl) | 0 | NHCO | p-phenylene | 0 | CO | 16 |
| 1(3-) | (4-OH) | 0 | NHCO | p-phenylene | 0 | NHCO | 18 |
| 1(3-) | (4-OH) | 0 | NHCO | p-phenylene | 0 | CONH | 20 |
| 1(4-) | (3-OH) | 0 | NHCO | p-phenylene | 0 | NHCONH | 18 |
| 1(4-) | (3-$OCH_3$) | 1 | NHCO | p-phenylene | 0 | OCO | 14 |
| 1(4-) | (3-OH) | 0 | NHCO | p-phenylene | 0 | COO | 18 |
| 1(4-) | (3-Cl) | 0 | NHCO | p-phenylene | 0 | $SO_2$ | 18 |
| 1(4-) | (3-OH) | 0 | NHCO | p-phenylene | 0 | $SO_2NH$ | 18 |
| 1(4-) | — | 0 | CONH | — | 0 | — | 18 |
| 1(4-) | — | 1 | CONH | — | 0 | — | 20 |
| 2(3-,5-) | — | 0 | CONH | — | 0 | — | 14 |
| 2(4-) | (3-OH) | 0 | CONH | — | 0 | — | 18 |
| 1(4-) | (2-$CH_3$) | 0 | CONH | — | 0 | — | 16 |
| 1(4-) | (3-Cl) | 2 | CONH | — | 0 | — | 18 |
| 1(3-) | (4-OH) | 0 | CONH | — | 0 | — | 22 |
| 1(4-) | (3-OH) | 0 | CONH | — | 6 | O | 14 |
| 1(4-) | (3-OH) | 1 | CONH | p-phenylene | 0 | O | 18 |
| 1(4-) | (3-Cl) | 0 | CONH | p-phenylene | 0 | S | 16 |
| 1(3-) | (4-OH) | 0 | CONH | p-phenylene | 0 | NHCO | 18 |
| 1(3-) | (4-OH) | 0 | CONH | p-phenylene | 0 | CONH | 20 |
| 1(4-) | (3-OH) | 0 | CONH | p-phenylene | 0 | NHCONH | 18 |
| 1(4-) | (3-$OCH_3$) | 1 | CONH | p-phenylene | 0 | OCO | 14 |
| 1(4-) | (3-OH) | 0 | CONH | p-phenylene | 0 | COO | 18 |
| 1(4-) | (3-Cl) | 0 | CONH | p-phenylene | 0 | $SO_2$ | 18 |
| 1(4-) | (3-OH) | 0 | CONH | p-phenylene | 0 | $SO_2NH$ | 18 |

TABLE 2-continued

| n | R | p | X | B | q | Y | r |
|---|---|---|---|---|---|---|---|
| 1(4-) | — | 0 | OCONH | — | 0 | — | 18 |
| 1(4-) | — | 2 | NHCOO | — | 0 | — | 20 |
| 2(3-,5-) | — | 0 | OCONH | — | 0 | — | 14 |
| 2(4-) | (3-OH) | 0 | NHCOO | — | 0 | — | 18 |
| 1(4-) | (2-$CH_3$) | 0 | OCONH | — | 0 | — | 16 |
| 1(4-) | (3-Cl) | 2 | NHCOO | — | 0 | — | 18 |
| 1(3-) | (4-OH) | 0 | OCONH | — | 0 | — | 22 |
| 1(4-) | (3-OH) | 0 | NHCOO | — | 6 | O | 14 |
| 1(4-) | (3-OH) | 0 | OCONH | p-phenylene | 0 | O | 18 |
| 1(4-) | (3-Cl) | 0 | NHCOO | p-phenylene | 0 | CO | 16 |
| 1(3-) | (4-OH) | 0 | OCONH | p-phenylene | 0 | NHCO | 18 |
| 1(3-) | (4-OH) | 0 | NHCOO | p-phenylene | 0 | CONH | 20 |
| 1(4-) | (3-OH) | 0 | OCONH | p-phenylene | 0 | NHCONH | 18 |
| 1(4-) | (3-$OCH_3$) | 1 | NHCOO | p-phenylene | 0 | OCC | 14 |
| 1(4-) | (3-OH) | 0 | OCONH | p-phenylene | 0 | COO | 18 |
| 1(4-) | (3-Cl) | 0 | NHCOO | p-phenylene | 0 | $SO_2$ | 18 |
| 1(4-) | (3-OH) | 0 | OCONH | p-phenylene | 0 | $SO_2NH$ | 18 |
| 1(4-) | — | 0 | OCO | — | 0 | — | 18 |
| 1(4-) | — | 1 | COO | — | 0 | — | 20 |
| 2(3-,5-) | — | 0 | OCO | — | 0 | — | 14 |
| 2(4-) | (3-OH) | 0 | COO | — | 0 | — | 18 |
| 1(4-) | (2-$CH_3$) | 0 | OCO | — | 0 | — | 16 |
| 1(4-) | (3-Cl) | 2 | COO | — | 0 | — | 18 |
| 1(3-) | (4-OH) | 0 | OCO | — | 0 | — | 22 |
| 1(4-) | (3-OH) | 0 | COO | — | 6 | O | 14 |
| 1(4-) | (3-OH) | 2 | OCO | p-phenylene | 0 | O | 18 |
| 1(4-) | (3-Cl) | 0 | COO | p-phenylene | 0 | S | 16 |
| 1(3-) | (4-OH) | 0 | OCO | p-phenylene | 0 | NHCO | 18 |
| 1(3-) | (4-OH) | 0 | COO | p-phenylene | 0 | CONH | 20 |
| 1(4-) | (3-OH) | 0 | OCO | p-phenylene | 0 | NHCONH | 18 |
| 1(4-) | (3-$OCH_3$) | 1 | COO | p-phenylene | 0 | OCO | 14 |
| 1(4-) | (3-OH) | 0 | OCO | p-phenylene | 0 | COO | 18 |
| 1(4-) | (3-Cl) | 0 | COO | p-phenylene | 0 | $SO_2$ | 18 |
| 1(4-) | (3-OH) | 0 | OCO | p-phenylene | 0 | $SO_2NH$ | 18 |
| 1(4-) | — | 0 | O | — | 0 | — | 18 |
| 1(4-) | — | 2 | S | — | 0 | — | 20 |
| 2(3-,4-) | — | 0 | O | — | 0 | — | 14 |
| 2(4-) | (3-OH) | 0 | S | — | 0 | — | 18 |
| 1(4-) | (2-$CH_3$) | 0 | O | — | 0 | — | 16 |
| 1(4-) | (3-Cl) | 2 | S | — | 0 | — | 18 |
| 1(3-) | (4-OH) | 0 | O | — | 0 | — | 22 |
| 1(4-) | (3-OH) | 0 | S | — | 6 | O | 14 |
| 1(4-) | (3-OH) | 1 | O | p-phenylene | 0 | O | 18 |
| 1(4-) | (3-Cl) | 0 | S | p-phenylene | 0 | CO | 16 |
| 1(3-) | (4-OH) | 0 | O | p-phenylene | 0 | NHCO | 18 |
| 1(3-) | (4-OH) | 0 | S | p-phenylene | 0 | CONH | 20 |
| 1(4-) | (3-OH) | 0 | O | p-phenylene | 0 | NHCONH | 18 |
| 1(4-) | (3-$OCH_3$) | 1 | S | p-phenylene | 0 | OCO | 14 |
| 1(4-) | (3-OH) | 0 | O | p-phenylene | 0 | COO | 18 |
| 1(4-) | (3-Cl) | 0 | S | p-phenylene | 0 | $SO_2$ | 18 |
| 1(4-) | (3-OH) | 0 | O | p-phenylene | 0 | $SO_2NH$ | 18 |
| 1(4-) | — | 0 | $SO_2$ | — | 0 | — | 18 |
| 1(4-) | — | 1 | $SO_2NH$ | — | 0 | — | 20 |
| 2(3-,5-) | — | 0 | $SO_2$ | — | 0 | — | 14 |
| 2(4-) | (3-OH) | 0 | $SO_2NH$ | — | 0 | — | 18 |
| 1(4-) | (2-$CH_3$) | 0 | $SO_2$ | — | 0 | — | 16 |
| 1(4-) | (3-Cl) | 2 | $SO_2NH$ | — | 0 | — | 18 |
| 1(3-) | (4-OH) | 0 | $SO_2$ | — | 0 | — | 22 |
| 1(4-) | (3-OH) | 0 | $SO_2NH$ | — | 6 | O | 14 |
| 1(4-) | (3-OH) | 1 | $SO_2$ | p-phenylene | 0 | O | 18 |
| 1(4-) | (3-Cl) | 0 | $SO_2NH$ | p-phenylene | 0 | S | 16 |
| 1(3-) | (4-OH) | 0 | $SO_2$ | p-phenylene | 0 | NHCO | 18 |
| 1(3-) | (4-OH) | 0 | $SO_2NH$ | p-phenylene | 0 | CONH | 20 |
| 1(4-) | (3-OH) | 0 | $SO_2$ | p-phenylene | 0 | NHCONH | 18 |
| 1(4-) | (3-$OCH_3$) | 1 | $SO_2NH$ | p-phenylene | 0 | OCO | 14 |
| 1(4-) | (3-OH) | 0 | $SO_2$ | p-phenylene | 0 | COO | 18 |
| 1(4-) | (3-Cl) | 0 | $SO_2NH$ | p-phenylene | 0 | $SO_2$ | 18 |
| 1(4-) | (3-OH) | 0 | $SO_2$ | p-phenylene | 0 | $SO_2NH$ | 18 |

As the color developer, a phenol compound having a structure capable of controlling the cohesion between molecules is also preferably used. For instance, a phenol compound represented by the following formula (3) can be used as the color developer.

(3)

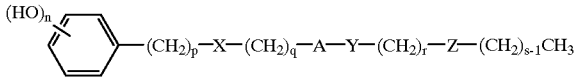

Specific examples of the phenol compound of formula (3) are shown in TABLE 3. In the above-mentioned formula (3), n is an integer of 1 to 3. In other words, a phenol moiety has 1 to 3 hydroxyl groups. For example, 4-hydroxyphenyl, 3-hydroxyphenyl, 2-hydroxyphenyl, 2,4-dihydroxyphenyl, 3,4-dihydroxyphenyl, or 3,4,5-trihydroxyphenyl is employed. The above-mentioned phenyl group may have a substituent in addition to the hydroxyl group(s). Further, other aromatic rings may be replaced as long as they have a phenolic hydroxyl group.

TABLE 3

| p | X | q | A | Y | r | Z | s |
|---|---|---|---|---|---|---|---|
| 0 | NHCO | 0 | — | — | 0 | — | 21 |
| 2 | NHCO | 0 | — | — | 0 | — | 18 |
| 2 | NHCO | 1 | — | NHCONH | 0 | — | 16 |
| 0 | NHCO | 1 | — | NHCO | 0 | — | 19 |
| 0 | NHCO | 1 | — | NHCOCONH | 0 | — | 18 |
| 0 | NHCO | 1 | — | NHCO | 3 | NHCONH | 18 |
| 2 | NHCO | 2 | — | CONK | 0 | — | 18 |
| 0 | NHCO | 5 | — | NHCONH | 0 | — | 18 |
| 0 | NHCO | 10 | — | NHCOCONH | 0 | — | 14 |
| 0 | NHCO | 2 | — | CONHNHCO | 0 | — | 17 |
| 2 | NHCO | 10 | — | CONHCONH | 0 | — | 16 |
| 0 | NHCO | 7 | — | NHCONHCO | 0 | — | 11 |
| 0 | NHCO | 6 | — | CONHNHCONH | 0 | — | 18 |
| 2 | NHCO | 11 | — | NHCONHNHCO | 0 | — | 17 |
| 0 | NHCO | 3 | — | NHCONHNH | 0 | — | 18 |
| 0 | NHCO | 5 | — | $SO_2$ | 0 | — | 18 |
| 0 | NHCO | 5 | — | NHCO | 5 | NHCONH | 14 |
| 2 | NHCO | 11 | — | CONH | 1 | CONHNHCO | 13 |
| 0 | NHCO | 1 | p-phenylene | O | 0 | — | 18 |
| 0 | NHCO | 2 | p-phenylene | NHCONH | 0 | — | 18 |
| 0 | NHCO | 4 | — | OCO | 0 | — | 15 |
| 0 | NHCO | 6 | — | SCO | 0 | — | 17 |
| 2 | NHCO | 2 | — | OCONH | 0 | — | 14 |
| 0 | NHCO | 10 | — | S | 0 | — | 20 |
| 1 | CONH | 6 | — | $SO_2$ | 0 | — | 21 |
| 2 | CONH | 3 | — | COO | 0 | — | 18 |
| 1 | CONH | 1 | — | NHCO | 0 | — | 19 |
| 2 | CONH | 2 | — | CONH | 0 | — | 18 |
| 2 | CONH | 5 | — | NHCONH | 0 | — | 18 |
| 1 | CONH | 10 | — | NHCOCONH | 0 | — | 14 |
| 2 | CONH | 2 | — | CONHNHCO | 0 | — | 17 |
| 2 | CONH | 10 | — | CONHCONH | 0 | — | 16 |
| 3 | CONH | 7 | — | NHCONHCO | 0 | — | 11 |
| 1 | NHCONH | 6 | — | CONHNHCONH | 0 | — | 18 |
| 2 | NHCONH | 11 | — | NHCOCONH | 0 | — | 16 |
| 2 | NHCONH | 3 | — | NHCO | 0 | — | 18 |
| 1 | NHCONH | 5 | — | $SO_2$ | 0 | — | 18 |
| 2 | NHCONH | 5 | — | CONHNHCO | 5 | NHCONH | 18 |
| 2 | CONHNHCO | 11 | — | NHCO | 0 | — | 14 |
| 1 | CONHNHCO | 6 | — | O | 6 | NHCOCONH | 18 |
| 2 | CONHNHCO | 2 | p-phenylene | NHCONH | 0 | — | 18 |
| 2 | COO | 1 | — | NHCO | 0 | — | 19 |
| 1 | COO | 5 | — | NHCONH | 0 | — | 18 |
| 2 | COO | 2 | — | CONHNHCO | 0 | — | 17 |
| 2 | COO | 7 | — | NHCONHCO | 0 | — | 11 |
| 2 | COO | 11 | — | NHCONHNHCO | 0 | — | 17 |
| 2 | COO | 3 | — | NHCONHNH | 0 | — | 18 |
| 1 | COO | 5 | — | $SO_2$ | 0 | — | 18 |
| 2 | COO | 11 | — | CONH | 1 | CONHNHCO | 14 |
| 2 | COO | 2 | p-phenylene | NHCONH | 0 | — | 18 |
| 3 | SCO | 5 | — | NHCONH | 0 | — | 18 |
| 2 | COS | 10 | — | NHCOCONH | 0 | — | 14 |
| 6 | SCO | 2 | — | NHCONHNHCO | 0 | — | 17 |
| 2 | COS | 10 | — | NHCONHCO | 0 | — | 16 |
| 2 | CONH | 7 | — | CONHNHCO | 0 | — | 11 |
| 1 | CONH | 6 | — | CONHNHCONH | 0 | — | 18 |
| 2 | CONH | 2 | — | NHCONNNHCO | 0 | — | 17 |
| 2 | CONH | 3 | — | NHCONHNH | 0 | — | 18 |
| 3 | CONH | 5 | — | $SO_2$ | 0 | — | 18 |

TABLE 3-continued

| p | X | q | A | Y | r | Z | s |
|---|---|---|---|---|---|---|---|
| 1 | CONH | 6 | — | NHCO | 5 | NHCONH | 18 |
| 2 | CONH | 11 | — | CONH | 1 | — | 14 |
| 2 | CONH | 4 | — | O | 0 | NHCOCOCH | 18 |
| 1 | CONH | 2 | p-phenylene | NHCONH | 0 | — | 18 |
| 1 | NHCOCONH | 10 | — | CONH | 0 | — | 22 |
| 2 | NHCOCONH | 3 | — | $SO_2$ | 0 | — | 18 |
| 2 | OCONH | 4 | — | NHCO | 0 | — | 19 |
| 2 | NHCOO | 2 | — | CONH | 0 | — | 18 |
| 3 | OSONH | 5 | — | NHCONH | 0 | — | 18 |
| 2 | $NHSO_2$ | 10 | — | NHCOCONH | 0 | — | 14 |
| 1 | $NHSO_2$ | 2 | — | CONHNHCO | 0 | — | 17 |
| 2 | NNSOO | 7 | — | NHCONHCO | 0 | — | 11 |
| 3 | $SO_3$ | 6 | — | CONNNHCONH | 0 | — | 18 |
| 2 | $SO_2$ | 11 | — | NHCONHNHCO | 0 | — | 17 |
| 1 | $SO_2$ | 3 | — | NHCONHNH | 0 | — | 18 |
| 2 | NHCO | 1 | — | NHCOCONH | 0 | — | 16 |
| 2 | NHCO | 1 | — | NHCONH | 0 | — | 14 |
| 1 | CONHNHCO | 1 | — | NHCONHNH | 0 | — | 18 |
| 2 | CONHNHCO | 1 | — | $NHSO_2$ | 0 | — | 18 |
| 2 | NHCONHCO | 1 | — | NHCONHCO | 0 | — | 17 |
| 1 | NHCONHCO | 1 | — | NHCO | 10 | NHCONH | 18 |
| 2 | CONHCO | 1 | — | NHNHCONH | 0 | — | 12 |
| 0 | CONHCONH | 8 | — | $SO_2$ | 0 | — | 18 |
| 0 | CONHCONH | 5 | — | NHCO | 5 | NHCONH | 18 |
| 0 | CONHCONH | 11 | — | CONH | 0 | — | 14 |
| 0 | CONHCONH | 2 | p-phenylene | O | 0 | — | 18 |
| 0 | CONHCONH | 2 | p-phenylene | S | 0 | — | 18 |
| 0 | CONHCONH | 2 | p-phenylene | COO | 0 | — | 21 |
| 0 | CH═N | 10 | — | NHCOCONH | 0 | — | 18 |
| 0 | CH═N | 1 | — | NHCONH | 0 | — | 20 |
| 0 | CH═N | 2 | p-phenylene | CONH | 0 | — | 18 |
| 0 | CONH | 0 | — | — | 0 | — | 22 |
| 0 | COO | 0 | — | — | 0 | — | 16 |
| 0 | S | 0 | — | — | 0 | — | 18 |
| 0 | $NHSO_2$ | 0 | — | — | 0 | — | 14 |
| 0 | $SO_2$ | 0 | — | — | 0 | — | 18 |
| 0 | O | 0 | — | — | 0 | — | 20 |
| 0 | OCOO | 0 | — | — | 0 | — | 18 |
| 0 | $SO_2NH$ | 0 | — | — | 0 | — | 18 |
| 0 | NHCONH | 0 | — | — | 0 | — | 18 |
| 0 | COS | 0 | — | — | 0 | — | 14 |
| 0 | SCO | 0 | — | — | 0 | — | 17 |
| 0 | $NHSO_2$ | 0 | — | — | 0 | — | 18 |
| 0 | NHCOO | 0 | — | — | 0 | — | 22 |
| 0 | NHSONH | 0 | — | — | 0 | — | 18 |
| 0 | N═CH | 0 | — | — | 0 | — | 17 |
| 0 | CO | 0 | — | — | 0 | — | 15 |
| 0 | CONNNHCO | 0 | — | — | 0 | — | 18 |
| 0 | OCO | 0 | — | — | 0 | — | 17 |
| 0 | OCONH | 0 | — | — | 0 | — | 16 |
| 0 | SCOO | 0 | — | — | 0 | — | 14 |
| 0 | SCONH | 0 | — | — | 0 | — | 18 |
| 0 | NHCOCONH | 0 | — | — | 0 | — | 18 |
| 1 | NHCO | 0 | — | — | 0 | — | 17 |
| 3 | NHCO | 0 | — | — | 0 | — | 15 |
| 2 | NHCONH | 0 | — | — | 0 | — | 18 |
| 1 | NHCONH | 0 | — | — | 0 | — | 16 |
| 4 | CONHNHCO | 0 | — | — | 0 | — | 17 |
| 2 | CONHNHCO | 0 | — | — | 0 | — | 21 |
| 2 | NHCOCONH | 0 | — | — | 0 | — | 18 |
| 2 | CONHCONH | 0 | — | — | 0 | — | 20 |
| 2 | OCONH | 0 | — | — | 0 | — | 18 |
| 0 | NHCO | 0 | p-phenylene | O | 0 | — | 22 |
| 0 | NHCO | 0 | p-phenylene | NHCONH | 0 | — | 18 |
| 0 | CONH | 0 | p-phenylene | CONH | 0 | — | 18 |
| 0 | CONH | 0 | p-phenylene | CONHNHCO | 0 | — | 17 |
| 0 | $NHSO_2$ | 0 | p-phenylene | NHCO | 0 | — | 19 |
| 0 | S | 0 | p-phenylene | CONH | 0 | — | 18 |
| 0 | S | 0 | p-phenylene | NHCOO | 0 | — | 18 |
| 0 | S | 0 | p-phenylene | NHCOCONH | 0 | — | 16 |
| 0 | NHCONH | 0 | p-phenylene | NHCONH | 0 | — | 14 |
| 0 | NHCONH | 0 | p-phenylene | CONHNHCO | 0 | — | 17 |
| 0 | CH═N | 0 | p-phenylene | CONHCONH | 0 | — | 16 |
| 0 | N═CH | 0 | p-phenylene | S | 0 | — | 18 |
| 0 | NHCSNH | 0 | p-phenylene | COO | 0 | — | 20 |
| 0 | S | 1 | p-phenylene | NHCONH | 0 | — | 18 |
| 0 | S | 2 | p-phenylene | NHCONHNH | 0 | — | 18 |

TABLE 3-continued

| p | X | q | A | Y | r | Z | s |
|---|---|---|---|---|---|---|---|
| 0 | NHCO | 1 | p-phenylene | NHCONHCO | 0 | — | 19 |
| 0 | NHCO | 2 | p-phenylene | NHCO | 0 | — | 17 |
| 0 | CONH | 2 | p-phenylene | OCONH | 0 | — | 18 |
| 0 | CONH | 1 | p-phenylene | CONHNHCO | 0 | — | 17 |
| 0 | CONH | 1 | — | NHCO | 0 | — | 21 |
| 0 | CONH | 2 | — | NHCONH | 0 | — | 18 |
| 0 | S | 2 | — | NHCONH | 0 | — | 19 |
| 0 | S | 10 | — | NHCONH | 0 | — | 18 |
| 0 | S | 2 | — | CONHNHCO | 0 | — | 17 |
| 0 | S | 2 | — | CONHNHCONH | 0 | — | 14 |
| 0 | S | 1 | — | CONH | 0 | NHCONH | 18 |
| 0 | S | 2 | — | CONH | 1 | NHCO | 17 |
| 1 | CONH | 1 | — | NHCO | 0 | — | 17 |
| 2 | CONH | 1 | — | NHCONH | 0 | — | 18 |
| 0 | NHCO | 1 | — | CONH | 0 | — | 18 |
| 0 | NHCO | 1 | — | CONHNHCO | 0 | — | 17 |
| 0 | CONHNHCO | 2 | — | S | 0 | — | 12 |
| 0 | CONHNHCO | 10 | — | S | 0 | — | 10 |
| 2 | CONHNHCO | 2 | — | S | 0 | — | 14 |
| 0 | S | 10 | — | CONHNHCO | 2 | S | 18 |
| 0 | $SO_2$NHCONH | 2 | p-phenylene | NHCONH | 0 | — | 18 |
| 0 | $SO_2$NHCONH | 0 | p-phenylene | COO | 0 | — | 18 |
| 0 | $SO_2$ | 10 | — | NHCONH | 0 | — | 18 |
| 0 | $SO_2$ | 6 | — | CONHNHCO | 0 | — | 19 |
| 0 | $SO_2$ | 0 | p-phenylene | CONHNHCO | 0 | — | 18 |

The coloring agent for use in the present invention is an electron donating compound such as a colorless or light-colored dye precursor (leuco dye). Such a leuco compound is not particularly limited, and the conventional leuco dyes, for example, phthalide compounds, azaphthalide compounds, fluoran compounds, phenothiazine compounds, and leuco auramine compounds may be appropriately selected.

The following compounds of formulas (4) and (5) are preferably used as the coloring agents in the present invention.

(4)

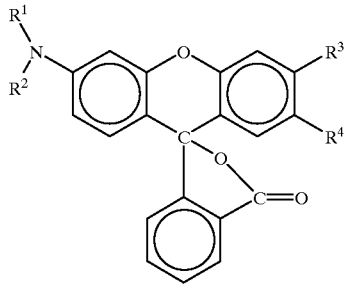

(5)

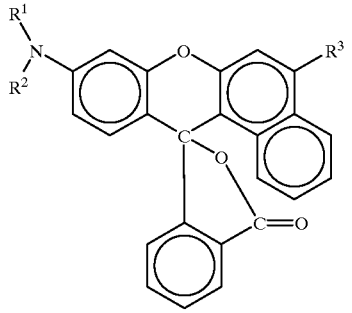

wherein $R^1$ is a hydrogen atom or an alkyl group having 1 to 4 carbon atoms; $R^2$ is an alkyl group having 1 to 6 carbon atoms, a cycloalkyl group, or a phenyl group which may have as a substituent an alkyl group such as methyl group or ethyl group, an alkoxyl group such as methoxy group or ethoxy group, or a halogen atom; $R^3$ is a hydrogen atom, an alkyl group having 1 or 2 carbon atoms, an alkoxyl group, or a halogen atom; and $R^4$ is a hydrogen atom, methyl group, a halogen atom, or an amino group which may have as a substituent an alkyl group, a substituted or unsubstituted aryl group, or a substituted or unsubstituted aralkyl group. The aryl group or aralkyl group may have a substituent such as an alkyl group, a halogen atom, or an alkoxyl group.

Specific examples of the coloring agents represented by formulas (4) and (5) are as follows:

2-anilino-3-methyl-6-diethylaminofluoran, 2-anilino-3-methyl-6-di(n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-methylamino) fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trichlotomethylanilino)-3-methyl-6-(N-cyclohexyl-N-methylamino)fluoran, 2-(2,4-dimethylanilino)-3-methyl-6-diethylaminofluoran,
2-(N-ethyl-p-toluidino)-3-methyl-6-(N-ethylanlino) fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2-(p-acetylanilino)-6-(N-n-amyl-N-n-butylamino) fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylanino-6-(N-propylanilino)fluoran,
2-ethylamino-6-(N-methyl-p-toluidino)fluoran,
2-methylamino-6-(N-methyl-2,4-diethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino) fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran, and
1,2-benzo-6-(N-ethyl-N-toluidino)fluoran.

Other examples of the coloring agent for use in the present invention are as follows:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylamino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino) fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino)fluoran,
2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran,
Benzoyl leuco methylene blue,
2-[3,6-bis(diethylamino)]-6-(o-chloroanilino) xanthylbenzoic acid lactam, 2-(3,6-diethylamino)-9-(o-chloroanilino)xanthylbenzoic acid lactam, 3,3-bis(p-dimethylaminophenyl)phthalide, 3,3-bis(p-dimethylaminophenyl)-6-dimethylaminophthalide (Crystal Violet Lactone), 3,3-bis-(p-dimethylaminophenyl)-6-diethylaminophthalide, 3,3-bis-(p-dimethylaminophenyl)-6-chlorophthalide, 3,3-bis-(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide, 3,6-bis(dimethylamino)fluorenespiro(9,3')-6'-dimethylaminophthalide, 3-(1-ethyl-2-methylindol-3-yl)-3-(2-ethoxy-4-diethylaminophenyl)-4-azaphthalide, 3-(1-octyl-2-methylindol-3-yl)-3-(2-ethoxy-4-diethylaminophenyl)-4-azaphthalide, 3-(1-ethyl-2-methylindol-3-yl)-3-(2-ethoxy-4-diethylaminophenyl)-7-azaphthalide, 3,3-bis(2-ethoxy-4-diethylaminophenyl)-4-azaphthalide, 3,3-bis(2-ethoxy-4-diethylaminophenyl)-7-azaphthalide, 6'-chloro-8'-methoxy-benzoindolino-spiropyran, and 6'-bromo-2'-methoxy-benzoindolino-spiropyran.

The reversible thermosensitive recording layer for use in the present invention can assume a color-developed state and a decolorized state relatively by controlling the temperature of the coloring composition contained in the recording layer in the heating step and/or controlling the cooling rate in the cooling step after the heating step. The color development and decolorization phenomenon of the reversible thermosensitive coloring composition for use in the present invention will now be explained with reference to FIG. 1.

Figure 1:
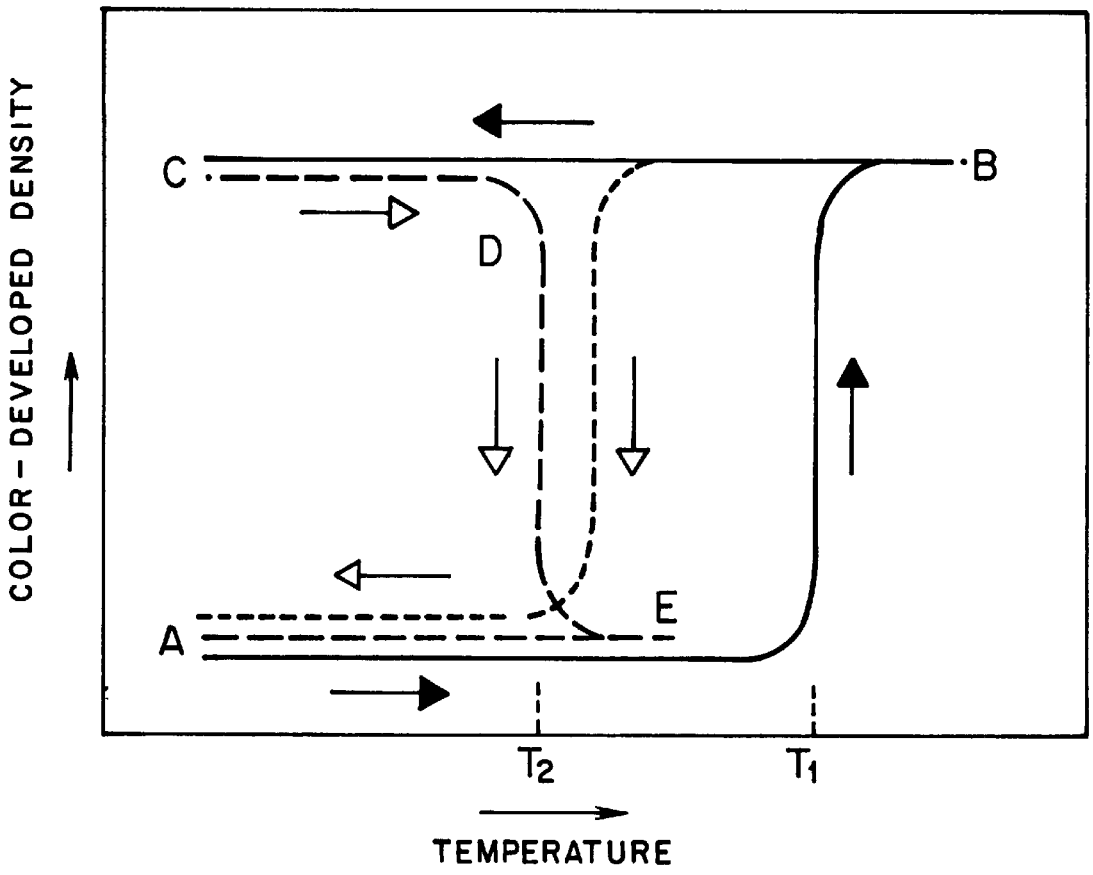
FIG. 1 is a diagram showing the color development and decolorization properties of a reversible thermosensitive recording medium of the present invention depending on the temperature thereof.

In FIG. 1, the abscissa axis of the graph indicates the temperature of a reversible thermosensitive coloring composition, and the ordinate axis indicates the color-developed density of the reversible thermosensitive coloring composition. As is apparent from the graph, the color-developed density of the reversible thermosensitive coloring composition for use in the present invention changes depending on the temperature thereof.

In FIG. 1, reference symbol A shows the decolorized state of the reversible thermosensitive coloring composition at room temperature. When the temperature of the coloring composition in the decolorized state A is raised and reaches a temperature $T_1$, the color development takes place because the coloring composition begins to fuse at the temperature $T_1$. Thus, reference symbol B shows the color-developed state of the composition in a fused condition.

When the temperature of the fused composition in the color-developed state B is rapidly decreased to room temperature, the color-developed state is maintained as the color-developed state C, passing along the route indicated by the solid line between B and C. Reference symbol C shows the color-developed state of the composition in a solid form at room temperature. It depends on the descending rate of temperature in the cooling step whether the color-developed state of the coloring composition can be maintained at room temperature or not. If the fused coloring composition in the color-developed state B is gradually cooled, decolorization takes place while the temperature is descending, passing along the route indicated by the dotted line between B and A. As a result, the coloring composition returns to the initial decolorized state A, or the color-developed density of the composition becomes relatively lower than that of the composition in the color-developed state C.

When the composition in the color-developed state C, which is obtained from the color-developed state B by rapid cooling, is heated again, decolorization takes place at a temperature $T_2$, that is lower than the color development temperature (image formation temperature) $T_1$, and the color-developed density of the composition is decreased, passing along the route indicated by the broken line between D and E. Thereafter, by decreasing the temperature of the composition, the composition is returned to the initial decolorized state A. The color development temperature and the decolorization temperature vary depending on the color developer and coloring agent employed for the reversible thermosensitive coloring composition, so that the color developer and the coloring agent may be selected according to the application of the reversible thermosensitive coloring composition. In addition, the color-developed density of the composition in the color-developed state B is not always the same as that of the composition in the color-developed state C.

In the color-developed state C of the reversible thermosensitive coloring composition, which is obtained at room temperature by rapidly cooling the fused composition in the color-developed state B, the color developer and the coloring agent are mixed to such a degree that the molecules of the color developer and the coloring agent are in contact with each other to induce the coloring reaction. In such a color-developed state C, the color developer and the coloring agent form an aggregation structure on a molecular level to maintain the color development phenomenon. It is considered that the color-developed state can be maintained in a stable condition at room temperature owing to the formation of the above-mentioned aggregation structure.

On the other hand, the molecules of the color developer and those of the coloring agent cause the phase separation in the decolorized state. In such a decolorized state, the molecules of at least one component, the color developer or the coloring agent, are independently gathered to form a domain or caused to crystallize out. The molecules of the coloring agent can be separated from those of the color developer by the formation of a domain or crystallization, so that the decolorized state can be stabilized. According to the present invention, in many cases, the completely decolorized state can be obtained by the phase separation of the color developer from the coloring agent, and the crystallization of the color developer.

As shown in FIG. 1, the decolorization takes place when the fused composition in the color-developed state B is gradually cooled, or when the solid composition in the color-developed state C is heated to the temperature $T_2$. In both cases, the aggregation structure of the molecules of the color developer and the coloring agent is broken, and at the same time, the phase separation is induced and the color developer crystallizes out in the composition at the decolorization temperature.

In the reversible thermosensitive recording medium of the present invention, an image can be formed in the recording layer in such a manner that the recording medium is heated to fuse the coloring composition, for example, by using a thermal head, and then rapidly cooled. To erase the image, the recording medium is once heated and thereafter gradually cooled. Alternatively, the recording medium in the color-developed state is heated to a temperature ($T_2$) which is lower than the color development temperature ($T_1$). The above-mentioned two methods for erasing the image are the same in the sense that the recording medium is temporarily retained at a temperature where the molecules of the color developer and those of the coloring agent cause phase separation or at least one of the color developer or the coloring agent is caused to crystallize.

In the color development process, the recording medium is once heated to the color development temperature, and then rapidly cooled. Such a rapid cooling step is necessary to prevent the reversible thermosensitive recording medium from being retained at the temperature of phase separation or crystallization.

To achieve the rapid or gradual cooling operation in the color development and decolorization process, the temperature-descending rate may be relatively determined according to the combination of the color developer and the coloring agent for use in the reversible thermosensitive coloring composition.

The mixing ratio of the coloring agent to the color developer in the reversible thermosensitive coloring composition varies depending on the combination of compounds to be employed. In most cases, it is preferable that the molar ratio of the color developer to the coloring agent be in the range of 0.1 to 20, more preferably 0.2 to 10. When the ratio of the coloring developer to the coloring agent is within the above-mentioned range, the color-developed density of a color-developed state is sufficient.

Further in the recording layer, it is preferable that the coloring agent and the color developer be finely and uniformly dispersed in a binder resin. The coloring agent and the color developer may be separately prepared into particles, but preferably, the coloring agent and the color developer may be prepared together into composite particles where two components are dispersed. Such composite particles can be accomplished by once melting or dissolving the coloring agent and the color developer in combination.

To form the reversible thermosensitive recording layer, the coloring agent and the color developer are independently dispersed or dissolved in proper solvents, and the obtained solution or dispersion may be mixed to prepare a coating liquid for recording layer. Alternatively, a mixture of the components is dispersed or dissolved in a solvent to prepare a coating liquid for recording layer. The recording layer coating liquid thus prepared may be coated on a support and dried.

The coloring agent and the color developer for use in the recording layer may be enclosed in microcapsules.

In the reversible thermosensitive recording medium of the present invention, a variety of additives may be contained, when necessary, in order to improve and control the coating characteristics of the reversible thermosensitive recording layer. Examples of the additives include a dispersant, a surfactant, an electroconductivity imparting agent, a filler, a lubricant, an antioxidant, a light stabilizer, an ultraviolet absorber, an agent for stabilizing color development, and a decolorization accelerating agent.

Examples of the binder resin used for the formation of the reversible thermosensitive recording layer include poly (vinyl chloride), poly(vinyl acetate), vinyl chloride-vinyl acetate copolymer, ethyl cellulose, polystyrene, styrene copolymers, phenoxy resin, polyester, aromatic polyester, polyurethane, polycarbonate, polyacrylate, polymethacrylate, acrylic acid based copolymer, maleic acid based copolymer, poly(vinyl alcohol), modified poly(vinyl alcohol), hydroxyethyl cellulose, carboxymethyl cellulose, and starches.

The above-mentioned binder resins serve to maintain the components for use in the reversible thermosensitive coloring composition uniform in the recording layer so that the components may not be partially accumulated by the application of heat to the recording layer in the repetition of recording and the erasing operations. In light of the function of the binder resin for use in the reversible thermosensitive recording layer, highly heat-resistant resin is preferably employed. A curing resin may be used for the formation of the reversible thermosensitive recording layer.

As the above-mentioned curing resin, there can be used any resin that is curable by cross-linking under application of heat, electron radiation, or ultraviolet radiation. Such a cross-linked resin can be obtained by selecting the combination of a cross-linking agent and a resin comprising an active group reactive with the above-mentioned cross-linking agent.

As the thermosetting resin, there can be employed various resins having hydroxyl group or carboxyl group that is reactive with the cross-linking agent, for example, phenoxy resin, poly(vinyl butyral) resin, cellulose acetate propionate, and cellulose acetate butyrate. Further, there can be employed copolymer resins comprising a monomer with hydroxyl group or carboxyl group. Examples of such copolymer resins are vinyl chloride-vinyl acetate-vinyl alcohol copolymer, vinyl chloride-vinyl acetate-hydroxypropyl acrylate copolymer, and vinyl chloride-vinyl acetate-maleic anhydride copolymer.

There are isocyanate compounds, amine compounds, phenol compounds, and epoxy compounds as the cross-linking agents for thermal cross-linking. With respect to the isocyanate compounds, polyisocyanate compounds having a plurality of isocyanate groups, for example, hexamethylene diisocyanate (HDI), toluene diisocyanate (TDI), and xylylene diisocyanate (XDI) can be employed. Further, an adduct of the above-mentioned isocyanate compound with trimethylolpropane, an isocyanurate type compound, and a blocked isocyanate compound are also usable. When the cross-linking agent is added to the resin, it is preferable that the ratio of the number of functional groups contained in the cross-linking agent to the number of active groups contained in the resin be in the range of 0.01 to 2.0. When the cross-linked resin is obtained by the addition of a cross-linking agent in such an amount, the strength of the cross-linked resin is sufficient in terms of the heat resistance. Further, the addition of the cross-linking agent has no adverse effect on the color development and decolorization properties.

As a cross-linking accelerating agent, any catalyst conventionally used in the above-mentioned cross-linking reaction may be used. For example, a tertiary amine compound such as 1,4-diaza-bicyclo[2,2,2]octane, and a metal compound such as an organic tin compound are used as the cross-linking accelerating agents.

The resin may be subjected to not only heat application, but also ultraviolet light irradiation or electron beam irradiation.

The following monomers can be used for ultraviolet curing and electron radiation curing.

Specific examples of the monofunctional monomers are methyl methacrylate, ethyl methacrylate, n-butyl methacrylate, i-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, dimethylaminoethyl methacrylate methylchloride salt, diethylaminoethyl methacrylate, glycidyl methacrylate, tetrahydrofurfuryl methacrylate, allyl methacrylate, ethylene glycol dimethacrylate, triethylene glycol dimethacrylate, tetraethylene glycol dimethacrylate, 1,3-butylene glycol dimethacrylate, 1,6-hexanediol dimethacrylate, trimethylolpropane trimethacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicyclopentenylethyl acrylate, N-vinyl pyrrolidone, and vinyl acetate.

Specific examples of the bifunctional monomers are as follows: 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, bisphenol A ethylene oxide adduct diacrylate, glycerin methacrylate acrylate, diacrylate with 2-mole adduct of propylene oxide of neopentyl glycol, diethylene glycol diacrylate, polyethylene glycol (400) diacrylate, diacrylate of the ester of hydroxypivalic acid and neopentyl glycol, 2,2-bis(4-acryloxydiethoxyphenyl)propane, diacrylate of neopentyl glycol diadipate, diacrylate of ϵ-caprolactone adduct of neopentyl glycol hydroxypivalate, 2-(2-hydroxy-1,1-dimethylethyl)-5-hydroxymethyl-5-ethyl-1,3-dioxanediacrylate, tricyclodecanedimethylol diacrylate, ϵ-caprolactone adduct of tricyclodecanedimethylol diacrylate, and diacrylate of glycidyl ether of 1,6-hexanediol.

Specific examples of the polyfunctional monomers are as follows: trimethylolpropane triacrylate, glycerin propylene oxide adduct acrylate, trisacryloyloxyethyl phosphate, pentaerythritol acrylate, triacrylate with 3-mole adduct of propylene oxide of trimethylolpropane, dipentaerythritol polyacrylate, polyacrylate of caprolactone adduct of dipentaerythritol, triacrylate of dipentaerythritol propionate, hydroxypivalaldehyde-modified dimethylolpropane triacrylate, tetraacrylate of dipentaerythritol propionate, ditrimethylolpropane tetraacrylate, pentaacrylate of dipentaerythritol propionate, dipentaerythritol hexaacrylate, and ϵ-caprolactone adduct of dipentaerythritol hexaacrylate.

One example of the oligomer is bisphenol A—diepoxyacrylic acid adduct.

When the cross-linking reaction is carried out by ultraviolet irradiation, the following photopolymerization initiators and photopolymerization promoters are used.

Specific examples of the photopolymerization initiators for use in the present invention include benzoin ethers such as isobutyl benzoin ether, isopropyl benzoin ether, benzoin ethyl ether, and benzoin methyl ether; α-acyloxym esters such as 1-phenyl-1,2-propanedione-2-(o-ethoxycarbonyl) oxym; benzylketals such as 2,2-dimethoxy-2-phenylacetophenone and benzyl hydroxycyclohexylphenylketone; acetophenone derivatives such as diethoxyacetophenone and 2-hydroxy-2-methyl-1-phenylpropane-1-one; and ketones such as benzophenone, 1-chlorothioxanthone, 2-chlorothioxanthone, isopropyl thioxanthone, 2-methylthioxanthone, and 2-chlorobenzophenone.

Those photopolymerization initiators can be used alone or in combination. It is preferable to employ such a photopolymerization initiator in an amount of 0.005 to 1.0 part by weight, more preferably 0.01 to 0.5 parts by weight, to one part of the previously mentioned monomer or oligomer.

As the photopolymerization promotor, aromatic tertiary amine compounds and aliphatic amine compounds can be used, Specific examples of the photopolymerization promoters include isoamyl p-dimethylaminobenzoate and ethyl p-dimetylaminobenzoate.

These photopolymerization promoters can be used alone or in combination. It is preferable to employ such a photopolymerization promotor in an amount of 0.1 to 5 parts by weight, more preferably in an amount of 0.3 to 3 parts by weight, to one part by weight of a photopolymerization initiator.

As the light source for ultraviolet light irradiation apparatus, a mercury lamp, a metal halide lamp, a gallium lamp, a mercury xenon lamp, or a flashlamp may be employed. However, any light source can be employed as long as it has a light emitting spectrum corresponding to the ultraviolet absorption wavelength of the previously mentioned photopolymerization initiators and photopolymerization promotors. As to the conditions for ultraviolet light irradiation, the lamp output and transportation speed may be determined in accordance with the irradiation energy necessary for cross-linking the resin.

Generally, electron beam (EB) irradiation apparatus can be classified into a scan beam EB irradiation apparatus and an area beam EB irradiation apparatus. An appropriate ES irradiation apparatus may be chosen in accordance with the desired irradiation area, exposure and other factors, with the current, radiation width and transportation speed being taken into consideration.

In the reversible thermosensitive recording medium of the present invention, a reversible thermosensitive recording layer and a printing layer are basically overlaid on a support, A recording-layer protection layer and a printing-layer protection layer may be respectively provided on the reversible thermosensitive recording layer and the printing layer to improve the head-matching properties in the recording operation and the repetition durability.

The printing layer may be provided by offset printing, gravure printing or screen printing, using a pigment- or dye-containing printing ink. A vehicle for the printing ink may employ a thermosetting resin, UV-curing resin, or EB-curing resin in consideration of the adhesion, heat resistance, and durability of the printing layer.

For the formation of the recording-layer protection layer and printing-layer protection layer, poly(vinyl alcohol), polyacrylate, polymethacrylate, and other resins which are commonly used in the conventional thermosensitive recording medium are usable. In particular, a curing resin is preferably used for the formation of the recording-layer protection layer, and a heat-resistant resin is preferable for the preparation of the printing-layer protection layer.

The curing resin for use in the recording-layer protection layer is a curable resin by the application of heat, electron beam, or ultraviolet light, which may be determined in light of the combination of a curing agent and an active group contained in a resin reactive with the curing agent. The same thermosetting resin, UV-curing resin, and EB-curing resin as mentioned in the formation of the reversible thermosensitive recording layer are suitable for the recording-layer protection layer.

Polyimide and polyamideimide are given as preferable examples of the heat-resistant resins for use in the printing-layer protection layer.

The recording-layer protection layer and the printing-layer protection layer may further comprise additives such as an ultraviolet absorber, inorganic and/or organic filler, and lubricant. As the resin for use in the recording-layer protection layer and the printing-layer protection layer, poly(vinyl alcohol), styrene-maleic anhydride copolymer, carboxy-modified polyethylene, melamine-formaldehyde resin, and urea-formaldehyde resin are also usable in addition to the above-mentioned curing resins.

An intermediate layer may be interposed between the reversible thermosensitive recording layer and the recording-layer protection layer, or between the printing layer and the printing-layer protection layer. The intermediate layer serves to improve the adhesion between the reversible thermosensitive recording layer and the recording-layer protection layer and between the printing layer and the printing-layer protection layer, to prevent the change in properties of the recording layer by the application of the protection layer coating liquid thereto, and to inhibit the additives contained in the recording-layer protection layer from transferring to the recording layer.

It is preferable to employ a resin with low oxygen permeability for the formation of the recording-layer protection layer and the intermediate layer provided on the reversible thermosensitive recording layer. The use of such a resin with low oxygen permeability makes it possible to reduce or prevent oxidation of the coloring agent and the color developer contained in the reversible thermosensitive recording layer.

Furthermore, an undercoat layer may be interposed as a heat insulating layer between the support and the reversible thermosensitive recording layer in order to make full use of heat applied to the recording medium. A dispersion of organic or inorganic minute void particles in a binder resin may be coated on the support, whereby the undercoat layer can be provided on the support. For the purpose of improving the adhesion of the reversible thermosensitive recording layer to the support, and inhibiting the materials constituting the recording layer from permeating through the support, an undercoat layer may be provided on the support.

The same binder resins as employed in the formation of the reversible thermosensitive recording layer can be used for the formation of the intermediate layer and the undercoat layer. The recording-layer protection layer, printing-layer protection layer, intermediate layer, reversible thermosensitive recording layer, and undercoat layer may further comprise an inorganic filler such as calcium carbonate, magnesium carbonate, titanium oxide, silicon oxide, aluminum hydroxide, kaolin, and talc, and/or various kinds of organic fillers. Moreover, a lubricant, surfactant, and dispersant may be contained in each of the above-mentioned layers.

To obtain an image in the reversible thermosensitive recording layer, the recording medium may be once heated to a temperature higher than the color development temperature (image formation temperature), and thereafter rapidly cooled. More specifically, the recording layer of the recording medium may be heated imagewise for a short period of time using a thermal head or by the application of laser beam thereto. In such a case, the recording layer is just partially heated, and the heat diffusion takes place immediately after the completion of heating step. Therefore, the recording medium can be rapidly cooled. Thus, a color-developed state can be maintained in a stable condition.

To erase the image formed in the reversible thermosensitive recording layer, the recording medium may be heated for a relatively long period of time, followed by gradual cooling, using an appropriate heat source. When the recording medium is heated for a relatively long period of time, the temperature of the recording medium is necessarily increased in a large area. Therefore, the temperature-descending rate becomes relatively slow in the cooling step, so that the decolorization takes place in the process of gradual cooling. In this case, a heat roller, heat stamp, or heated air may be used as the heating means, or the image may be heated for a long period of time by use of the thermal head.

Alternatively, the image can be erased from the recording layer by temporarily heating the recording medium to a specific temperature lower than the color development temperature. In this case, the thermal head is preferably employed as the heating means. To erase the image, the thermal energy applied to the recording medium by the thermal head may be relatively lowered by controlling the applied voltage, pulse number, pulse width, and pulse spacing as compared with the applied thermal energy in the image formation process. According to this method, image formation and image erasure can be carried out by use of the identical thermal head, and therefore, the overwriting operation can be achieved. As a matter of course, the heat roller and the heat stamp can also be employed in such a case.

Other features of this invention will become apparent in the course of the following description of exemplary embodiments, which are given for illustration of the invention and are not intended to be limiting thereof.

EXAMPLE 1

[Formation of Reversible Thermosensitive Recording Layer]

The following components were dispersed and pulverized to have an average particle size of 1 to 4 $\mu$m using a ball mill.

| | Parts by Weight |
|---|---|
| 2-anilino-3-methyl-6-dibutyl-aminofluoran | 2 |
| Color developer with the following structure: | 8 |
| 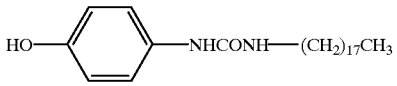 | |
| 15% tetrahydrofuran solution of phenoxy resin (Trademark "PKHH" made by Union Carbide Japan K.K.) | 150 |

To the above prepared dispersion, 20 parts by weight of a 75% ethyl acetate solution of adduct type hexamethylene diisocyanate (Trademark "Coronate HL" made by Nippon Polyurethane Industry Co., Ltd.) were added, and the resultant mixture was thoroughly stirred to prepare a coating liquid for reversible thermosensitive recording layer.

The recording layer coating liquid thus prepared was coated on the surface of a 100-$\mu$m-thick polyester film using a wire bar, and dried at 80° C. Thereafter, the coated layer was cured at 100° C. for 10 minutes, and then at 60° C. for 24 hours, so that a reversible thermosensitive recording layer with a thickness of about 6.0 $\mu$m was provided on the support.

[Formation of Recording-Layer Protection Layer]

The following components were thoroughly stirred and dissolved to prepare a coating liquid for recording-layer protection layer.

| | Parts by Weight |
|---|---|
| Urethane acrylate ultraviolet curing resin (Trademark "C7-157" made by Dainippon Ink & Chemicals, Incorporated | 10 |
| Ethyl acetate | 90 |

The recording-layer protection layer coating liquid thus prepared was coated on the reversible thermosensitive recording layer using a wire bar, and the coated layer was cured while being caused to pass through an ultraviolet lamp of 80 W/cm at a speed of 9 m/min. As a result, a recording-layer protection layer with a thickness of 3 $\mu$m was provided on the reversible thermosensitive recording layer.

[Formation of Printing Layer]

A design indicating a figure without the arms, as shown in FIG. 3, was printed in black ink on the above prepared recording-layer protection layer, using a commercially available offset press (made by KOMORI CORP.) with a commercially available UV ink (made by Toyo Ink Mfg. Co., Ltd.) at a dot density of 600 dpi.

[Formation of printing-layer protection layer]

A commercially available ink (made by Toyo Ink Mfg. Co., Ltd.) was coated on the above-mentioned printed portions. Thus, a printing-layer protection layer was provided.

Thus, a reversible thermosensitive recording medium No. 1 according to the present invention was obtained. The recording medium No. 1 was prepared into a card. The recording medium No. 1 showed such a cross-section as in FIG. 2.

Images indicating the arms, represented by B1 and B2 in FIG. 3, were repeatedly formed and erased in the reversible thermosensitive recording layer using a commercially available printer "R3000 Series" (Trademark), made by Kyushu Matsushita Electric Co., Ltd. The images B1 and B2 were black, so that the joint between the image A and the image B1 or B2 was not visually recognized.

EXAMPLE 2

The procedure for preparation of the reversible thermosensitive recording medium No. 1 in the form of a card in Example 1 was repeated except that a printing layer was provided, as illustrated in FIG. 7, in such a manner that a red solid image portion A1 and a green solid image portion A2 were disposed side by side using a commercially available UV color inks (made by Dainippon Ink and Chemicals, Inc.). The dot density was 1200 dpi and the total dot area occupied 70 to 80% of each image portion A1 or A2.

Thus, a reversible thermosensitive recording medium No. 2 according to the present invention was obtained.

Characters represented by B1 in FIG. 7 were freely written and erased many times in the underlying reversible thermosensitive recording layer using the same printer as in Example 1. The color of characters B1 was black, so that the black characters were visually recognized.

EXAMPLE 3

The procedure for preparation of the reversible thermosensitive recording medium No. 1 in the form of a card in Example 1 was repeated except that a printing layer was provided, as illustrated in FIG. 11B, in such a manner that vertical lines were printed in black ink at a dot density of 1200 dpi.

Thus, a reversible thermosensitive recording medium No. 3 according to the present invention was obtained.

Between the vertical lines, as shown in FIG. 11A, horiozontal lines were freely-drawn in the underlying reversible thermosensitive recording layer using the same printer as in Example 1. The horizontal lines were reversibly written and erased many times.

EXAMPLE 4

The procedure for preparation of the reversible thermosensitive recording medium No. 1 in the form of a card in Example 1 was repeated except that a printing layer was provided, as illustrated in FIG. 12A, in such a manner that secret characters (image A) were printed in black ink at a dot density of 600 dpi.

Thus, a reversible thermosensitive recording medium No. 4 according to the present invention was obtained.

As shown in FIG. 12A, a black solid image B was formed in the underlying reversible thermosensitive recording layer using the same printer as in Example 1. The black characters (image A) were completely concealed by the formation of the black solid image B. By erasing the black solid image B from the reversible thermosensitive recording layer, the characters were again recognized. This type of card was suitable for prevention of counterfeit.

EXAMPLE 5

The procedure for preparation of the reversible thermosensitive recording medium No. 1 in the form of a card in Example 1 was repeated except that the printing layer in Example 1 was replaced by such a printing layer as shown in FIG. 5A and FIG. 5B. Namely, dot printing was carried out at a dot density of 1200 dpi using a commercially available UV blue ink (made by T & K TOKA CO., LTD.) so that the total dot area occupied 20 to 80% of the printing layer. The printing layer was thus provided with blue gradation.

Thus, a reversible thermosensitive recording medium No. 5 according to the present invention was obtained.

An image was repeatedly formed in the reversible thermosensitive recording layer and erased therefrom in the same manner as in Example 1. The image formed in the recording layer was black, so that the image was visually recognized, and such a black image was easily recognized after repetition of the image formation and erasure. Furthermore, the adhesion between the printing layer and the printing-layer protection layer was excellent, the deterioration of the printing-layer protection layer was minimized.

EXAMPLE 6

The procedure for preparation of the reversible thermosensitive recording medium No. 1 in the form of a card in Example 1 was repeated except that a printing layer was provided in such a manner that a half part of a bar code image was printed in black ink using a commercially available UV black ink (made by Toyo Ink Mfg. Co., Ltd.) at a dot density of 1200 dpi.

Thus, a reversible thermosensitive recording medium No. 6 according to the present invention was obtained.

The remaining half part of the bar code image was formed in the reversible thermosensitive recording layer.

Even after the half part in the reversible thermosensitive recording layer was repeatedly erased and formed, the half part formed in the reversible thermosensitive recording layer was by no means inferior to the printed half part.

EXAMPLE 7

A commercially available TC film (Trademark "FB651", that is a white-opaque type reversible thermosensitive recording medium made by Ricoh Company, Ltd) was prepared into the form of a card.

[Formation of Printing Layer]

The printing layer was provided on the surface of the above prepared TC film in the same manner as in Example 1 except that the blue UV ink was replaced by a white UV ink (made by Toyo Ink Mfg. Co., Ltd.).

Thus, a reversible thermosensitive recording medium No. 7 according to the present invention was obtained. The recording medium No. 7 showed such a cross-section as illustrated in FIG. 2.

Images indicating the arms, represented by B1 and B2, were repeatedly formed and erased in the reversible thermosensitive recording layer in the same manner as in Example 1. The images B1 and B2 were white, so that the joint between the image A and the image B1 or B2 was not visually recognized.

Japanese Patent Application No. 11-359564 filed Dec. 17, 1999 is hereby incorporated by reference.

What is claimed is:

1. A method of using a reversible thermosensitive recording medium comprising a support, a reversible thermosensitive recording layer of which color tone is reversibly changeable with the application of heat thereto to change the temperature thereof, and a printing layer which bears a printed image A on said support, said method comprising the step of forming an image B in said reversible thermosensitive recording layer by heating said recording layer to an image formation temperature to complete a single composite image in combination with said printed image A.

2. The method as claimed in claim 1, further comprising the step of erasing said image B by heating said reversible thermosensitive recording layer to a temperature different from said image formation temperature.

3. The method as claimed in claim 2, wherein said steps of forming said image B in said reversible thermosensitive recording layer and erasing said image B therefrom are repeated.

4. The method as claimed in claim 1, wherein said image B has an area, said recording layer has an area greater than the area of said image B, and the step of forming the image B comprises imagewise heating the recording layer to an image formation temperature.

5. A reversible thermosensitive recording medium comprising:

a support, a reversible thermosensitive recording layer of which color tone is reversibly changeable with the application of heat thereto to change the temperature thereof, and a printing layer which bears a printed image A on said support, wherein when an image B is formed in said reversible thermosensitive recording layer by heating said recording layer, said image B completes a single composite image in combination with said printed image A.

6. The recording medium as claimed in claim 5, wherein said reversible thermosensitive recording layer comprises a reversible thermosensitive coloring composition which comprises an electron-donating coloring compound and an electron-accepting compound and is capable of assuming a color-developed state and a decolorized state relatively, depending upon the temperature to which said reversible thermosensitive coloring composition is heated and/or the cooling rate for said reversible thermosensitive coloring composition after the heating thereof.

7. The reversible thermosensitive recording medium as claimed in claim 5, wherein said reversible thermosensitive recording layer is provided in part of a surface of said recording medium.

8. The reversible thermosensitive recording medium as claimed in claim 5, wherein colors of said printed image A and said image B are not visually distinguishable.

9. The reversible thermosensitive recording medium as claimed in claim 5, wherein colors of said printed image A and said image B are visually distinguishable.

10. The reversible thermosensitive recording medium as claimed in claim 5, wherein said printed image A is printed by dot-printing.

11. The reversible thermosensitive recording medium as claimed in claim 10, wherein said dot-printing is carried out at a dot density of 100 dpi or more.

12. The reversible thermosensitive recording medium as claimed in claim 10, wherein a total dot area printed by said dot-printing occupies 20 to 99% of the entire area of said printed image A.

13. The reversible thermosensitive recording medium as claimed in claim 5, further comprising a protective layer for protecting said reversible thermosensitive recording layer, said protective layer comprising a curing resin or a heat-resistant resin.

14. The reversible thermosensitive recording medium as claimed in claim 5, further comprising a protective layer for protecting said printing layer, said protective layer comprising a curing resin or a heat-resistant resin.

15. The reversible thermosensitive recording medium as claimed in claim 5, wherein said support is transparent, and a second support is further applied to the back side of said support, using an adhesive.

16. The reversible thermosensitive recording medium as claimed in claim 15, further comprising a second printing layer which is interposed between said support and said second support.

17. The reversible thermosensitive recording medium as claimed in claim 5, wherein said reversible thermosensitive recording medium is in the form of a card.

18. The reversible thermosensitive recording medium as claimed in claim 5, wherein said reversible thermosensitive recording medium further bears thereon an IC memory, a magneto-optical recording medium, an optical recording medium, or a magnetic recording medium.

19. The reversible thermosensitive recording medium as claimed in claim 5, wherein said printing layer is successively overlaid on said reversible thermosensitive recording layer on said support in such a configuration that said printing layer and said reversible thermosensitive recording layer at least partly overlap to form an overlapping portion, and when said overlapping portion is viewed from above said reversible thermosensitive recording layer before said image B is formed, a reversible thermosensitive recording layer portion other than a reversible thermosensitive recording layer portion shielded by said printed image A of said printing layer is transparently visible through said overlapping portion.

20. The reversible thermosensitive recording medium as claimed in claim 19, wherein said printing layer has a thickness of 3 $\mu$m or less.

21. The reversible thermosensitive recording medium as claimed in claim 5, wherein said reversible thermosensitive recording layer is successively overlaid on said printing layer on said support in such a configuration that said printing layer and said reversible thermosensitive recording layer at least partly overlap to form an overlapping portion, and when said overlapping portion is viewed from above said reversible thermosensitive recording layer before said image B is formed, said printed image A of said printing layer is transparently visible in their entirety through said overlapping portion.

22. The reversible thermosensitive recording medium as claimed in claim 5, wherein said single composite image completed in combination of said image A and said image B is a bar code image.

23. The medium as claimed in claim 5, wherein said recording layer has an area such that said image B is formed by imagewise heating of said recording layer.

24. A reversible thermosensitive recording medium comprising:

a support, a reversible thermosensitive recording layer of which color tone is reversibly changeable with the application of heat thereto to change the temperature thereof, said reversible thermosensitive recording layer bearing an image B therein, and a printing layer which bears a printed image A, wherein said image B and said printed image A can be displayed at the same time so that in combination they constitute a composite image.

25. The recording medium as claimed in claim 24, wherein said reversible thermosensitive recording layer comprises a reversible thermosensitive coloring composition which comprises an electron-donating coloring compound and an electron-accepting compound and is capable of assuming a color-developed state and a decolorized state relatively, depending upon the temperature to which said reversible thermosensitive coloring composition is heated and/or the cooling rate for said reversible thermosensitive coloring composition after the heating thereof.

26. The reversible thermosensitive recording medium as claimed in claim 24, wherein said reversible thermosensitive recording layer is provided in part of a surface of said recording medium.

27. The reversible thermosensitive recording medium as claimed in claim 24, wherein colors of said printed image A and said image B are not visually distinguishable.

28. The reversible thermosensitive recording medium as claimed in claim 25, wherein colors of said printed image A and said image B are visually distinguishable.

29. The reversible thermosensitive recording medium as claimed in claim 24, wherein said printed image A is printed by dot-printing.

30. The reversible thermosensitive recording medium as claimed in claim 29, wherein said dot-printing is carried out at a dot density of 100 dpi or more.

31. The reversible thermosensitive recording medium as claimed in claim 29, wherein a total dot area printed by said dot-printing occupies 20 to 99% of the entire area of said printed image A.

32. The reversible thermosensitive recording medium as claimed in claim 24, further comprising a protective layer for protecting said reversible thermosensitive recording layer, said protective layer comprising a curing resin or a heat-resistant resin.

33. The reversible thermosensitive recording medium as claimed in claim 24, further comprising a protective layer for protecting said printing layer, said protective layer comprising a curing resin or a heat-resistant resin.

34. The reversible thermosensitive recording medium as claimed in claim 24, wherein said support is transparent, and a second support is further applied to the back side of said support, using an adhesive.

35. The reversible thermosensitive recording medium as claimed in claim 34, further comprising a second printing layer which is interposed between said support and said second support.

36. The reversible thermosensitive recording medium as claimed in claim 24, wherein said reversible thermosensitive recording medium is in the form of a card.

37. The reversible thermosensitive recording medium as claimed in claim 24, wherein said reversible thermosensitive recording medium further bears thereon an IC memory, a magneto-optical recording medium, an optical recording medium, or a magnetic recording medium.

38. The reversible thermosensitive recording medium as claimed in claim 24, wherein said single composite image completed in combination of said image A and said image B is a bar code image.

39. The medium as claimed in claim 24, wherein said recording layer has an area such that said image B is formed by imagewise heating of said recording layer.

* * * * *